US012385377B1

(12) United States Patent
Fisher

(10) Patent No.: US 12,385,377 B1
(45) Date of Patent: Aug. 12, 2025

(54) SYSTEM TO OPTIMIZE CENTRIFUGAL PUMPS AND MANIFOLDING IN VARIABLE RATE SLURRY PUMPING APPLICATIONS

(71) Applicant: Halliburton Energy Services, Inc., Houston, TX (US)

(72) Inventor: Chad A. Fisher, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/632,641

(22) Filed: Apr. 11, 2024

(51) Int. Cl.
*E21B 43/26* (2006.01)
*E21B 43/267* (2006.01)
*F04D 7/04* (2006.01)

(52) U.S. Cl.
CPC ..... *E21B 43/2607* (2020.05); *E21B 43/267* (2013.01); *F04D 7/04* (2013.01)

(58) Field of Classification Search
CPC ..... E21B 43/2607; E21B 43/267; F04D 7/04
See application file for complete search history.

(56) References Cited

U.S. PATENT DOCUMENTS

| | | | |
|---|---|---|---|
| 4,563,123 | A | 1/1986 | Beck |
| 6,644,844 | B2 | 11/2003 | Neal et al. |
| 7,090,017 | B2 | 8/2006 | Justus et al. |
| 7,845,413 | B2 | 12/2010 | Shampine et al. |
| 8,251,570 | B2 | 8/2012 | Hughes et al. |
| 9,816,509 | B2 | 11/2017 | Blaumann et al. |
| 10,569,242 | B2 | 2/2020 | Stegemoeller et al. |
| 10,675,601 | B2 | 6/2020 | Fisher |
| 11,441,068 | B2 | 9/2022 | Mazrooee et al. |
| 11,506,032 | B1 | 11/2022 | Fisher et al. |
| 11,519,252 | B2 | 12/2022 | Kramer et al. |
| 11,585,197 | B2 | 2/2023 | Mazrooee et al. |
| 11,591,888 | B2 | 2/2023 | Yeung et al. |

(Continued)

FOREIGN PATENT DOCUMENTS

| | | |
|---|---|---|
| WO | 2012097425 A1 | 7/2012 |
| WO | 2016090201 A1 | 6/2016 |

OTHER PUBLICATIONS

Foreign Communication from Related Application—International Search Report and Written Opinion of the International Searching Authority, International Application No. PCT/US2024/026943, dated Dec. 24, 2024, 12 pages.

(Continued)

*Primary Examiner* — James G Sayre
(74) *Attorney, Agent, or Firm* — Conley Rose, P.C.; Rodney B. Carroll

(57) ABSTRACT

A method includes providing a total flow rate of a proppant slurry by utilizing a slurry pump to provide a concentrated slurry flow rate of a concentrated slurry, utilizing a clean fluid pump to provide a clean pump flow rate of a clean fluid, and combining the clean pump flow rate of the clean fluid with the concentrated slurry flow rate of the concentrated slurry to provide the total pump flow rate of the proppant slurry. The clean fluid is substantially proppant free, the concentrated slurry has a higher concentration of the proppant than the proppant slurry, the total flow rate of the proppant slurry is greater than a maximum slurry pump flow rate of a preferred operating range (POR) of the slurry pump, and the concentrated slurry flow rate is less than or equal to the maximum slurry pump flow rate.

21 Claims, 9 Drawing Sheets

(56) References Cited

U.S. PATENT DOCUMENTS

| | | | | |
|---|---|---|---|---|
| 11,639,653 | B2 | 5/2023 | Bolen et al. | |
| 11,834,940 | B1 * | 12/2023 | Kohli | E21B 7/18 |
| 2003/0044272 | A1 | 3/2003 | Addie et al. | |
| 2004/0136825 | A1 | 7/2004 | Addie et al. | |
| 2007/0125543 | A1 | 6/2007 | McNeel et al. | |
| 2007/0277982 | A1 | 12/2007 | Shampine et al. | |
| 2008/0023681 | A1 | 1/2008 | Cunningham | |
| 2010/0254214 | A1 | 10/2010 | Fisher et al. | |
| 2012/0255734 | A1 | 10/2012 | Coli et al. | |
| 2014/0262338 | A1 | 9/2014 | Shen et al. | |
| 2014/0352968 | A1 | 12/2014 | Pitcher et al. | |
| 2016/0169221 | A1 | 6/2016 | Stephenson et al. | |
| 2018/0209254 | A1 * | 7/2018 | Ghasripoor | E21B 43/16 |
| 2020/0197883 | A1 | 6/2020 | Oklejas, Jr. | |
| 2021/0310346 | A1 | 10/2021 | Bull et al. | |
| 2022/0403723 | A1 | 12/2022 | Yeung et al. | |
| 2023/0032405 | A1 * | 2/2023 | Warren | E21B 43/2607 |
| 2023/0106807 | A1 | 4/2023 | Coli et al. | |
| 2023/0313654 | A1 | 10/2023 | Yeung et al. | |
| 2023/0332492 | A1 | 10/2023 | Hamida et al. | |

OTHER PUBLICATIONS

Foreign Communication from Related Application—International Search Report and Written Opinion of the International Searching Authority, International Application No. PCT/US2024/026945, dated Dec. 27, 2024, 9 pages.

Foreign Communication from Related Application—International Search Report and Written Opinion of the International Searching Authority, International Application No. PCT/US2024/026946, dated Jan. 3, 2025, 11 pages.

Filing Receipt, Specification and Drawings for U.S. Appl. No. 18/632,633, entitled, "Slurry Proportioner System," filed Apr. 11, 2024,72 pages.

Filing Receipt, Specification and Drawings for U.S. Appl. No. 18/632,640, entitled "Multi-Well Blending System," filed Apr. 11, 2024, 84 pages.

Freemyer Industrial Pressure, Jul. 2023 Information Journal, Dual Electric Blender For Test Pad; https:/www.indpress.com/update/may-2023-information-journal-wnpbl-9mkdr.

First Office Action dated Oct. 16, 2024 (8 pages), U.S. Appl. No. 18/632,640, filed Apr. 11, 2024.

* cited by examiner

SYSTEM TO OPTIMIZE CENTRIFUGAL PUMPS AND MANIFOLDING IN VARIABLE RATE SLURRY PUMPING APPLICATIONS

CROSS-REFERENCE TO RELATED APPLICATIONS

None.

STATEMENT REGARDING FEDERALLY SPONSORED RESEARCH OR DEVELOPMENT

Not applicable.

BACKGROUND

Subterranean hydraulic fracturing is conducted to increase or "stimulate" production from a hydrocarbon well. To conduct a fracturing process, high pressure is used to pump special fracturing fluids, including some that contain propping agents ("proppants") down-hole and into a hydrocarbon formation to split or "fracture" the rock formation along veins or planes extending from the well-bore. Once the desired fracture is formed, the fluid flow is reversed and the liquid portion of the fracturing fluid is removed. The proppants are intentionally left behind to stop the fracture from closing onto itself due to the weight and stresses within the formation. The proppants thus literally "prop-apart", or support the fracture to stay open, yet remain highly permeable to hydrocarbon fluid flow since they form a packed bed of particles with interstitial void space connectivity. Sand is one example of a commonly-used proppant. The newly-created-and-propped fracture or fractures can thus serve as new formation drainage area and new flow conduits from the formation to the well, providing for an increased fluid flow rate, and hence increased production of hydrocarbons. Two or more wells clustered together can be stimulated simultaneously with the same fracturing equipment.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

FIG. 4 is a schematic of a slurry blender according to embodiments of this disclosure;

FIG. 6 is a schematic of a hydraulic fracturing system, according to embodiments of this disclosure.

DETAILED DESCRIPTION

Figure 1:
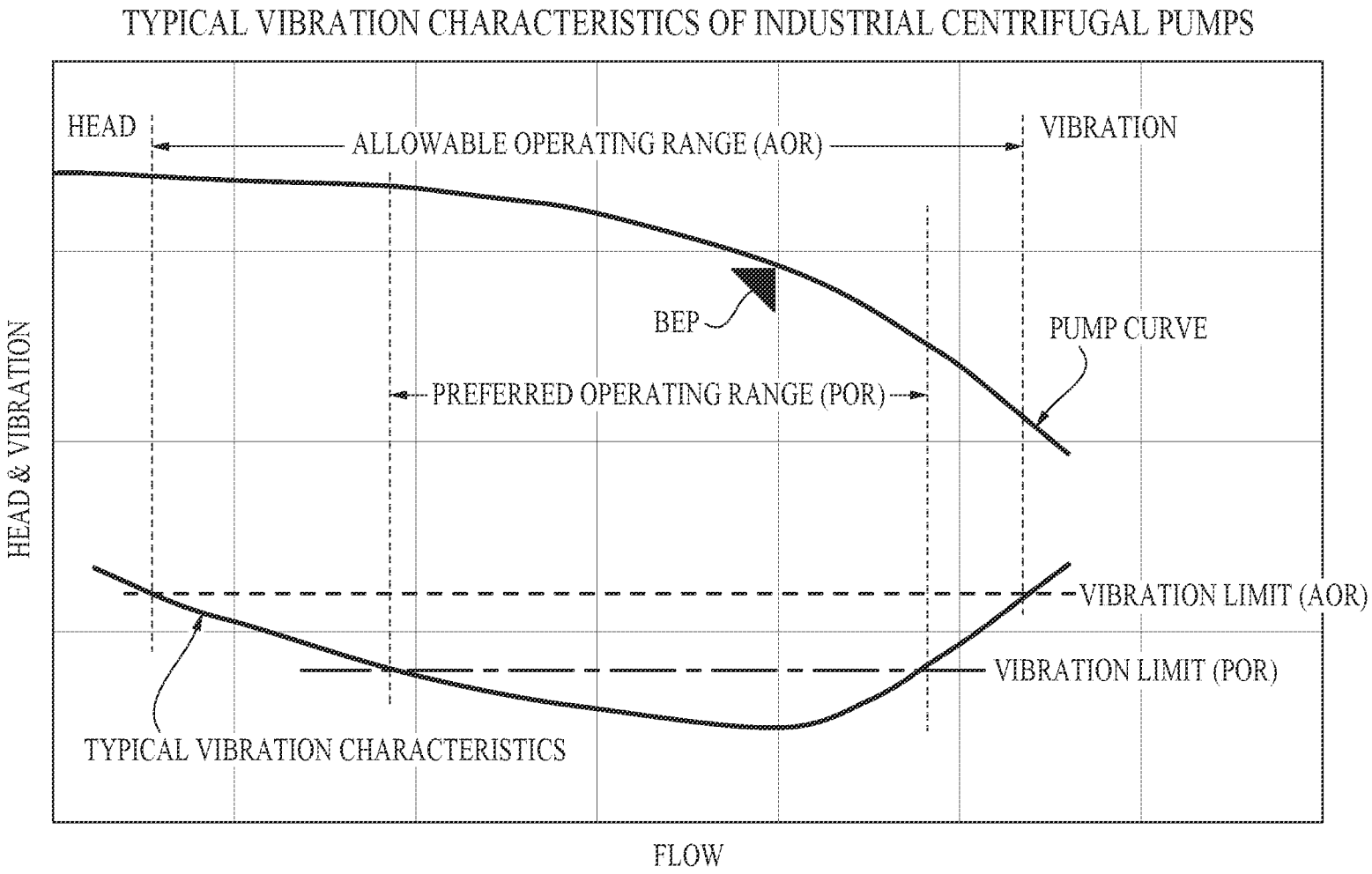
FIG. 1 is a representative plot of typical vibration characteristics, in relation to head pressure and rate output, of industrial centrifugal pumps.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

Throughout this disclosure, a reference numeral followed by an alphabetical character refers to a specific instance of an element and the reference numeral alone refers to the element generically or collectively. Thus, as an example (not shown in the drawings), widget "1a" refers to an instance of a widget class, which may be referred to collectively as widgets "1" and any one of which may be referred to generically as a widget "1". For example, reference to a slurry blender 40 can, in instances, include slurry blender 40A, slurry blender 40B, or a combination thereof.

Stimulation operations can present a wide range of slurry pumping needs. For example, the slurry pump (e.g., on a blending trailer) may need to operate from 20 bpm to 80 bpm for different job conditions. By nature of their design, centrifugal slurry pumps typically have a narrow preferred operating range for increased efficiency and reduced wear, which operating range can be narrower for more abrasive slurries. It is generally not practical to select individual pumps and manifolds (e.g., of different sizes, metallurgy, etc.) for each disparate operating condition. Accordingly, equipment is conventionally often operated outside of a range that is desirable for best longevity of the equipment (e.g., the centrifugal pump(s) utilized for pumping proppant slurries).

Increasing life of slurry pumps can be effected by limiting pump operating range to the POR, which conventionally mandates a different pump when a desired operating range is beyond the POR of the slurry pump being utilized. The different pump could have an improved metallurgy, or differing internal pump geometry/size, etc. However, metallurgy changes can result in a higher initial cost of the pump. Geometry changes to the slurry pump to reduce wear may also come with concomitant undesirable results, such as reducing pump rate or head pressure and/or increasing pump weight and cost.

Figure 2A:
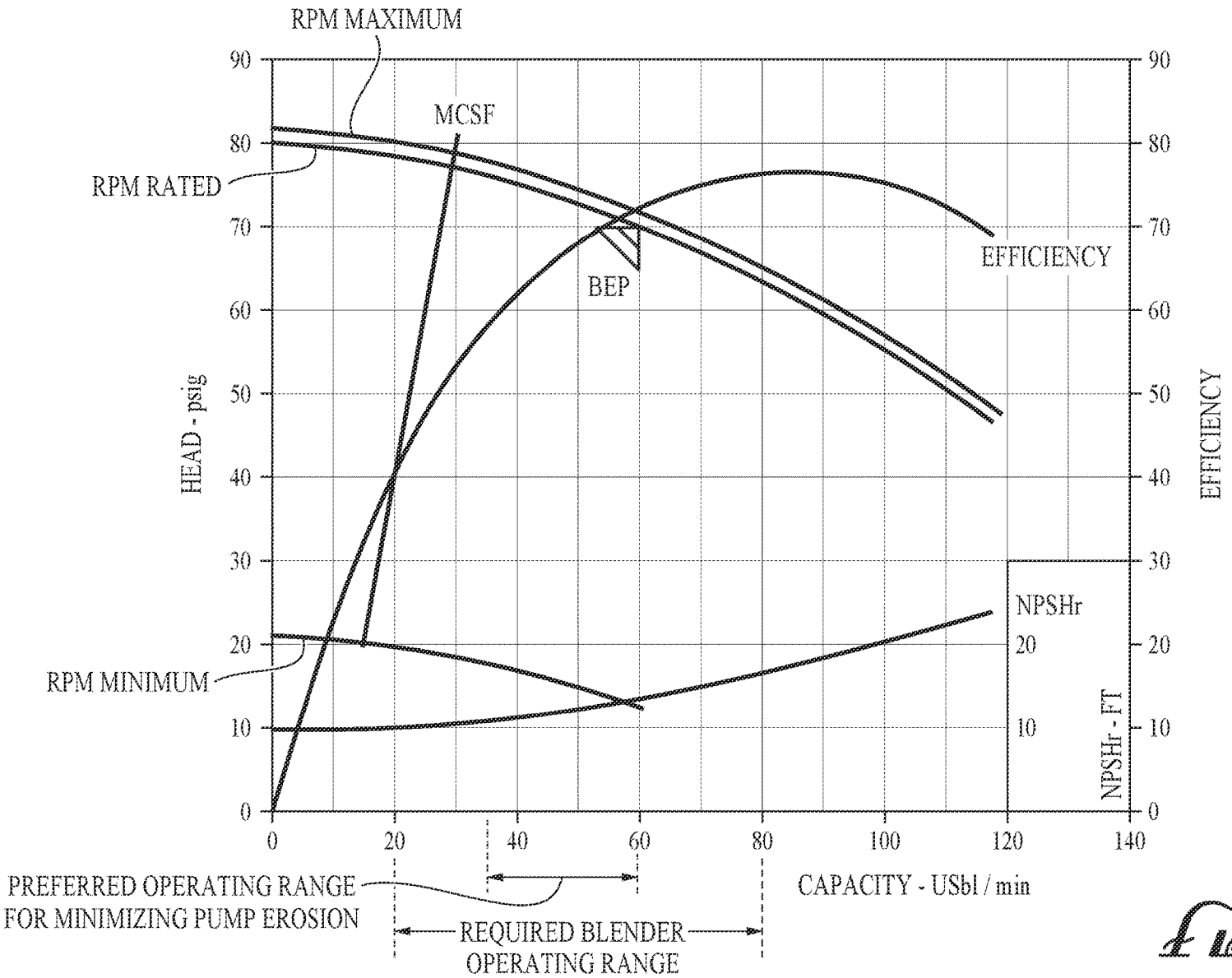
FIG. 2A is an example slurry pump curve, depicting best efficiency point (BEP), a preferred operating range (POR), and a desired operating range for an example slurry pump suitable for use in the system and method of this disclosure.

FIG. 1 is a representative plot of typical vibration characteristics of example, industrial centrifugal pumps. A given pump may have an allowable operating range in view of, for example, an allowable vibration limit. It may be preferable and recommended to operate the pump within a preferred operating range (POR) having a lower POR vibration limit (e.g., not exceeding the vibration limit). FIG. 2A depicts pump curves, including head pressure (psig) and efficiency as a function of the capacity for an example slurry centrifugal pump. As depicted in FIG. 2A, the slurry pump can have a best efficiency point (BEP) flow rate (also referred to herein simply as a "BEP"). The preferred operating range (POR) for a pump (e.g., which provides a range from a "minimum POR flow rate" to a "maximum POR flow rate") pumping a given slurry can be from a minimum recommended percentage of the BEP flow rate to a maximum recommended percentage of the BEP flow rate. The POR can depend on the characteristics (e.g., abrasiveness) of the given slurry being pumped. For example, TABLE 1 depicts an example wear service class designation for various slurries. A wear service class 1 can include light slurry class for mildly abrasive slurries; a wear service class 2 can include medium slurry class for abrasive slurries, a wear service class 3 can include heavy slurry class for highly abrasive slurries, and a wear service class 4 can include very heavy slurry class for extremely abrasive slurries. Proppant slurries can generally be abrasive, highly abrasive, or extremely abrasive, depending on the composition of the slurry (concentration and type of proppant, acidity, etc.).

TABLE 1

Example Wear Service Classes

| Wear Service Class | Slurry Class | Equivalent Duty Class |
|---|---|---|
| 1 | Light | Mildly Abrasive |
| 2 | Medium | Abrasive |
| 3 | Heavy | Highly Abrasive |
| 4 | Very Heavy | Extremely Abrasive |

Figure 2B:
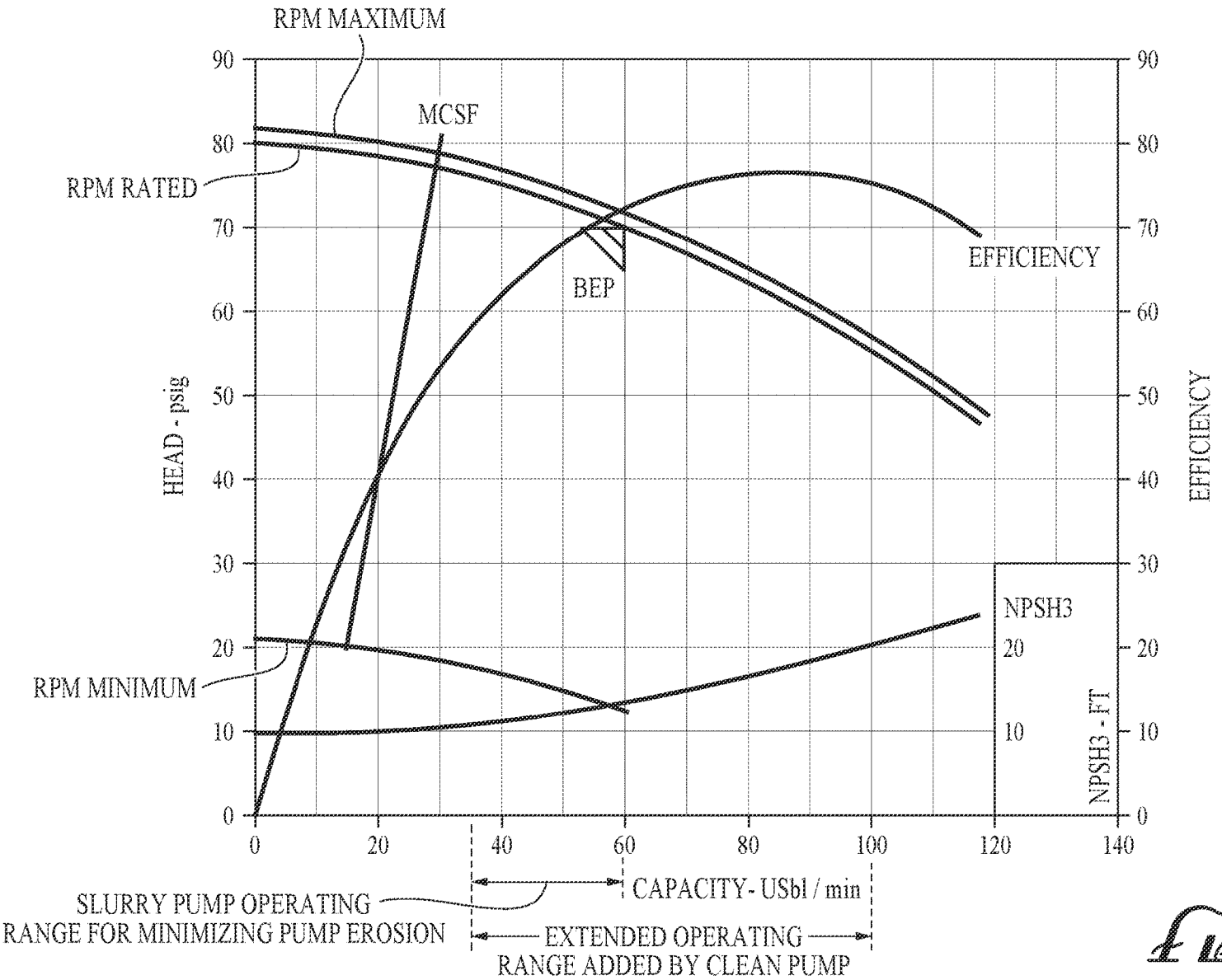
FIG. 2B is the example slurry pump curve of FIG. 2A showing the extended operating range that can be provided via a blending system and method of this disclosure.

TABLE 2 depicts an example preferred operating range (POR) for each wear service class for an example slurry pump such as the pump of FIG. 2A and FIG. 2B. For a given slurry pump, the POR for a slurry of a given wear service class may be estimated and/or provided/recommended by a manufacturer.

TABLE 2

Example Preferred Operating Ranges Based on Service Class

| | Service Class | | | |
|---|---|---|---|---|
| Operating Limits | 1 | 2 | 3 | 4 |
| Preferred Operating Range (POR) (% of BEP Flow Rate) | 30-125% | 40-120% | 50-105% | 60-100% |

Operating within the POR can minimize pump wear (e.g., erosion) during pumping of the slurry. For a service class 4 slurry of Table 2, the example POR of the slurry pump of Table 2 has a POR of from 60 to 100% of the BEP flow rate. Accordingly, as depicted in FIG. 2A, the preferred operating range within which slurry pump erosion can be minimized when pumping the given slurry in wear class 4 is from a minimum POR flow rate of 36 barrels per minute (bpm) to a maximum POR flow rate of 60 bpm, a range of just 24 (i.e., 60-36) bpm. This range can be much less than a desired range of operation. For example, in the example of FIG. 2A, an example desired/needed blender operation range can be from 20 bpm to 80 bpm, a 60 (i.e., 80-20) bpm range.

To enable maintenance of slurry pumps and associated header/manifold in a narrower operating range and close to the most desirable operating condition (e.g., within the POR), the slurry pump rate can be augmented by a clean fluid pump, as detailed herein, to increase a total system slurry production flow rate. Centrifugal pumps that are pumping clean fluid (e.g., a fluid comprising no or little proppant) are able to operate through a much wider operating flow rate range without exposure to abrasive wear. By operating a clean pump in parallel with a slurry pump, as disclosed herein, and metering the clean fluid stream into the slurry stream downstream of the slurry pump (e.g., to avoid increasing the total flow through the slurry pump that may exceed the POR), the slurry pump can be operated closer to (or at) its best efficiency point (BEP) and within the preferred operating range (POR). The combined (e.g., diluted) total slurry rate provided by the blender system can thus be higher than achievable by the slurry pump alone (when the slurry pump is operated within its POR), thus providing a desired amount of proppant slurry, while enabling a reduction in the wear on the slurry pump by keeping it within its desired percentage of the BEP flow rate.

For example, FIG. 2B is the example slurry pump curve of FIG. 2A showing the extended operating range that can be provided via a blending system and method of this disclosure. As depicted in FIG. 2B, although the POR is still between 36 and 60 bpm, the use of the clean fluid pump in addition to the slurry pump to provide the total slurry flow rate enables an extended operating range of, for example, 36 bpm to 100 bpm, while maintaining operation of the slurry pump in the POR, and thus minimizing erosion thereof. In the example of FIG. 2B, when augmenting the slurry pump with the clean pump in parallel, as per this disclosure, the blending unit slurry discharge rate range was increased from 24 bpm to 64 bpm, while maintaining the slurry pump operation within its desired preferred operating range to minimize wear.

As detailed further hereinbelow, a blender/blending system of this disclosure can comprise a slurry pump (e.g., with associated flowmeter and pressure transducer), a clean pump (e.g., with associated flowmeter, and pressure transducer), a proportional valve to throttle addition of a clean flow stream to the slurry, and a control system to monitor (e.g., flowrates and pressures) and control (e.g., speed of centrifugal pumps and position of the proportional valve of) the blending system. The blender slurry pump can maintain a desired pressure to fracturing pumps (e.g., Quintuplex pumps or other high pressure fracturing pumps). Once the slurry pump rate enters the POR and/or approaches the maximum percentage BEP flow rate, additional slurry rate can be augmented by adding clean fluid (e.g., from a clean fluid centrifugal pump) to the slurry stream (e.g., downstream of the slurry pump). This can allow for a total higher slurry rate to be provided; that is, the total slurry rate can be greater than the maximum POR flow rate which is the maximum available slurry rate that can be achieved with the slurry pump alone while maintaining the slurry pump operation within the POR thereof.

To maintain a proper clean fluid to concentrated slurry ratio, the control system can be configured to monitor the combined slurry and clean rates and control the proportion of clean rate (e.g., across a proportional valve) into the slurry stream. To ensure that the clean fluid enters the slurry stream, the proportion of clean fluid being added can be maintained at a higher discharge pressure (e.g., at least 10 psi or more higher) than the slurry pump discharge. This can be desirable, as flowing slurry across, for example, a proportional valve into the clean stream could undesirably erode the proportional valve.

A slurry blender (or "blending unit" or "blending system") of this disclosure will now be described with reference to FIG. 3A, which is a schematic of a blending system IA, according to embodiments of this disclosure, configured for providing a total flow rate of a proppant slurry; FIG. 3B, which is a schematic of another blending system IB, according to embodiments of this disclosure, configured for providing a total flow rate of a proppant slurry; and FIG. 4, which is a schematic of a slurry blender 40A suitable for use in blending system IA of FIG. 3A, according to embodiments of this disclosure.

A blending system of this disclosure can comprise: a slurry pump 50A operable to provide a concentrated slurry 45 in a concentrated slurry line 43, wherein the concentrated slurry 45 has a higher concentration of a proppant 18 than the proppant slurry 47; a clean fluid pump 50B operable to provide a clean fluid 44 in a clean fluid line 42, wherein the clean fluid is substantially proppant-free; and a control system (or "controller") 60 (described hereinbelow with reference to FIG. 4). The controller 60 can be configured to monitor a concentrated slurry flow rate $Q_{CS}$ of the concentrated slurry 45 in the concentrated slurry line 43 and a clean fluid flow rate $Q_{CF}$ of the clean fluid 44 in the clean fluid line 42, and control (e.g., a speed of) the concentrated slurry pump 50A and (e.g., a speed of) the clean fluid pump 50B, such that combination of the concentrated slurry 45 and the clean fluid 44 provides the proppant slurry 47 having the (e.g., desired/selected) total flow rate $Q_{TS}$. The total flow rate $Q_{TS}$ of the proppant slurry 47 can be greater than a maximum slurry pump flow rate of a preferred operating range (POR) of the slurry pump 50A (i.e., the maximum POR flow rate of the slurry pump 50A), while the concentrated slurry flow rate $Q_{CS}$ can be less than or equal to the maximum slurry pump flow rate of the POR, (e.g., the slurry pump flow rate can be above the BEP and/or within the POR of the slurry pump can be maintained above the minimum rate of the POR and below the maximum rate of the POR)). The concentrated slurry 45 in slurry line 43 can be produced in a mixer 70 via combination of proppant 18 with water/dilution fluid (e.g., introduced, for example, from water inlet line 21A via low pressure boost pump 20, water line 21A, and/or flow meter FM3)).

A flow meter FM1 can be positioned on the concentrated slurry flow line 43 and a flow meter FM2 can be positioned on clean fluid line 42, and for providing the concentrated slurry flow rate $Q_{CS}$ of the concentrated fluid 45 and the clean fluid flow rate $Q_{CF}$ of the clean fluid 44, respectively, to controller 60.

Figure 3A:
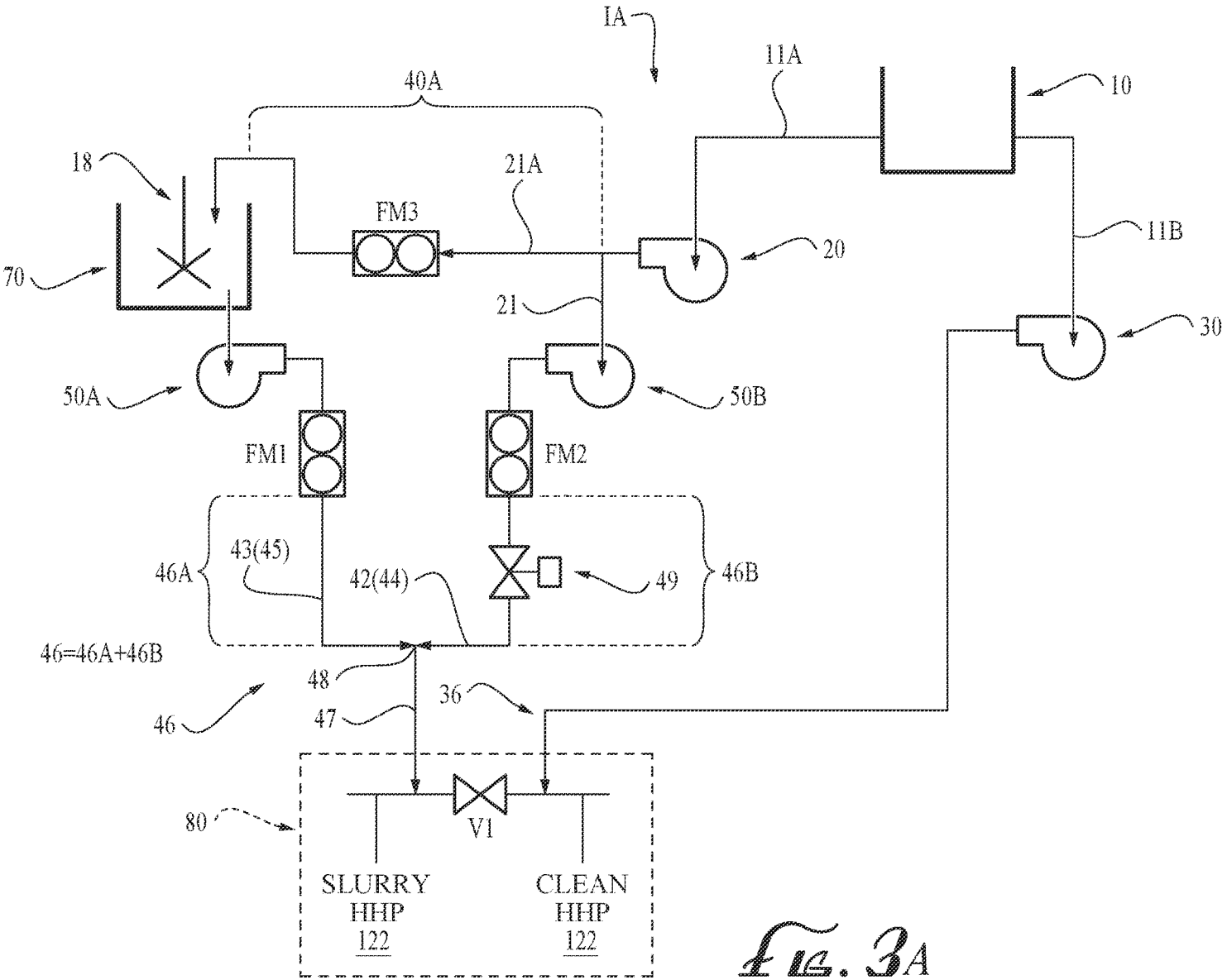
FIG. 3A is a schematic of a blending system, according to embodiments of this disclosure.
Figure 3B:
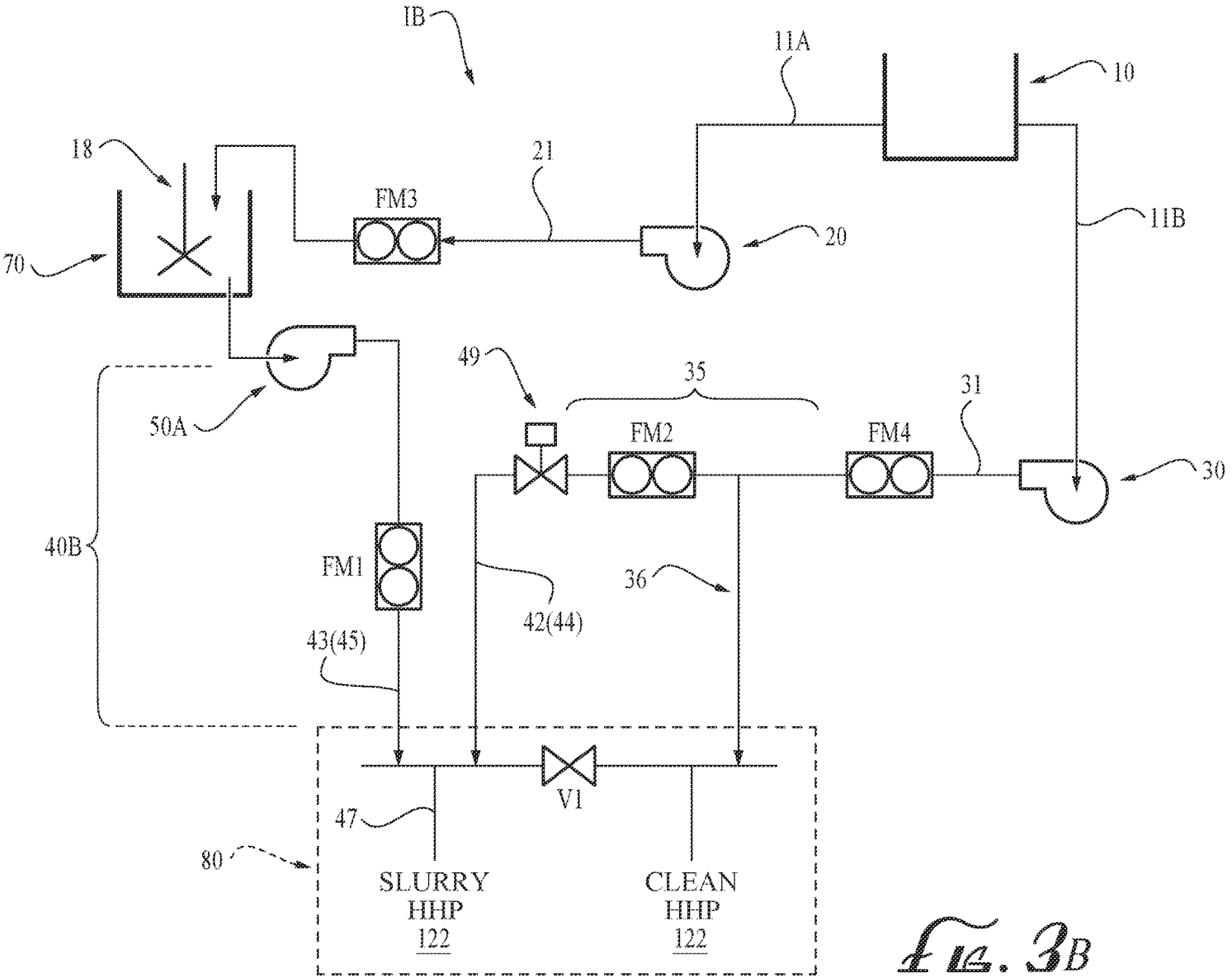
FIG. 3B is a schematic of another blending system, according to embodiments of this disclosure.
Figure 1:
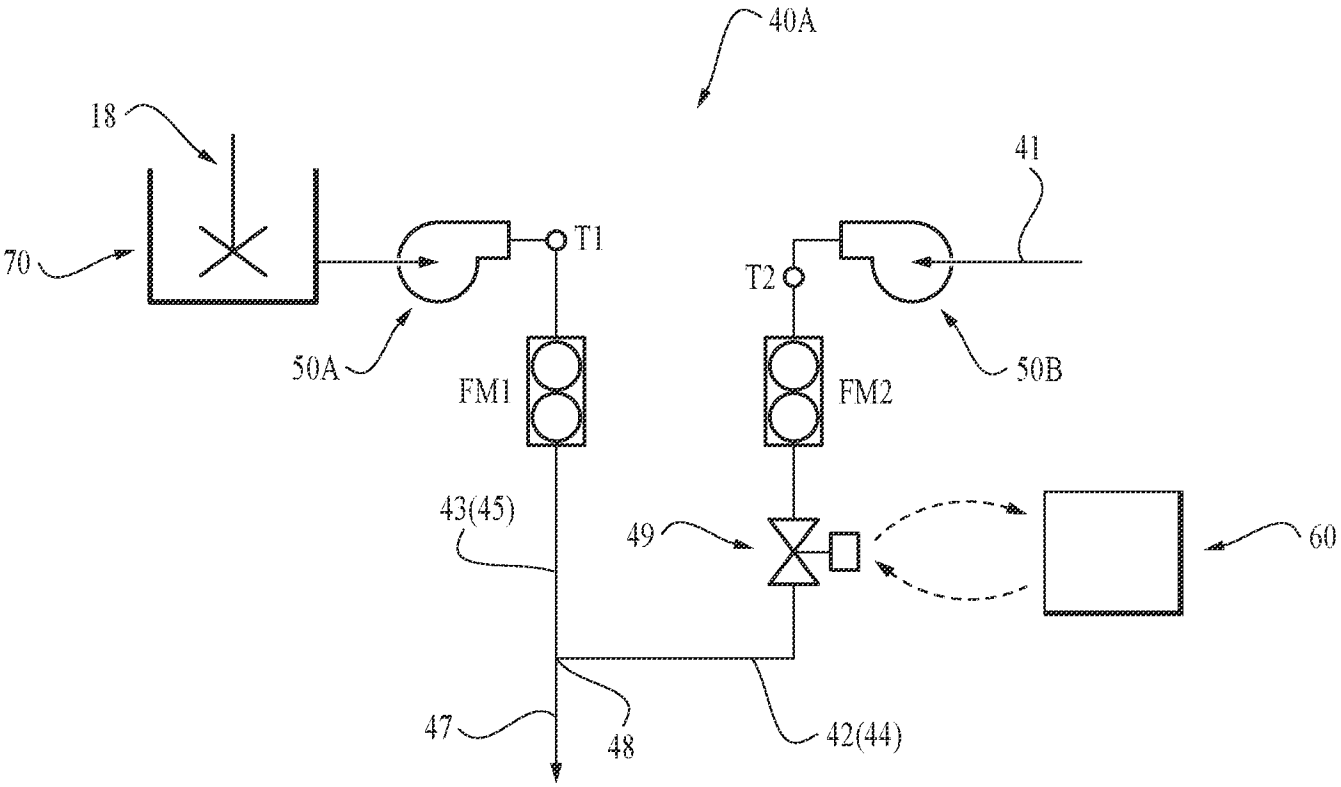

In embodiments, such as the embodiment of FIG. 3A, the slurry pump 50A and the clean fluid pump 50B can be positioned on a (e.g., same or different) mobile blender apparatus, for example to provide slurry blender 40A. In such embodiments, slurry blender 40A can be positioned, for example, on a blender trailer or one or more skid(s)). In other embodiments, such as depicted in the embodiment of FIG. 3B, a slurry blender 40B can comprise the concentrated slurry blender 50A, and the clean fluid blender 50B can be separate, for example, can be provided by a clean boost pump (CBT) 30 or clean boost apparatus 35, disparate from slurry blender 40B. An output of slurry blender 40A can comprise the proppant slurry 47, while an output of slurry blender 40B can comprise the concentrated slurry 45 (e.g., when the concentrated slurry 45 is combined with the clean fluid 44 after exit of the concentrated slurry 45) or can comprise the proppant slurry 47 (e.g., when the concentrated slurry 45 is combined with the clean fluid 44 within (e.g., a blender header 46 of) slurry blender 40B (as indicated by dashed line 44 in FIG. 3B)).

As depicted in the embodiment of FIG. 3A, in embodiments, water from water source 10 can be introduced via water suction lines 11A to a low pressure boost 20 (e.g., and water line 21) to a dilution fluid inlet line 41 of the slurry blender 40A/40B. One or more clean boost pump(s) 30 can be configured to introduce water/dilution fluid 36 from water source 10 to a (e.g., clean) manifold 80 (e.g., a manifold trailer configured to introduce proppant slurry 47 to one or more high pressure pumps 122 (described hereinbelow with reference to FIG. 6). As noted hereinabove, mixer 70 can receive proppant 18 to produce the concentrated slurry 45. Water from water source 10 can be introduced via water suction lines 11B and a clean boost pump 30 via clean boost line 36 and/or a valve V1 to manifold trailer 80 and/or via clean line 36 to one or more clean hydraulic fracturing pumps 122 (FIG. 6 hereinbelow). Valve V1 can typically be closed to isolate the slurry 45 from clean fluid 44, and the slurry and clean fluids can be combined after the high pressure pumps 122.

With reference back to the embodiment of FIG. 3A, slurry blender 40A/blending system IA can further include a blender header or low pressure manifold 46 (also referred to herein as a "slurry blender discharge manifold 46") fluidly connected to the concentrated slurry line 43 and the clean fluid line 42. As depicted in FIG. 3A, the concentrated slurry line 43 can be fluidly connected with a dirty/slurry side 46A of the blender header 46, and the clean fluid line 42 can be fluidly connected with another/clean side 46B of the blender header 46. In the embodiment of FIG. 3A, blender header 46 further comprises one or more outlets 48 for extracting the proppant slurry 47 therefrom.

With reference to the embodiment of FIG. 3B, which depicts a blender system IB where the clean flow rate can be provided from a separate unit from the concentrated slurry 45 flow, slurry blender 40B comprise discharge header 46 having one or more outlets 48 from which concentrated slurry 45 can be removed from slurry blender 40B. In such embodiments, as detailed further hereinbelow with reference to FIG. 4, slurry blender 40B can comprise a clean fluid flow meter FM2, a proportional valve 49 (also referred to herein as an actuated valve or a dilution valve 49) and associated feedback to controller 60, and can also comprise clean fluid pump 50B. In embodiments, clean boost pump 30 acts as clean fluid pump 50B. In the embodiment of FIG. 3B, clean boost apparatus 35 can receive water from one or more clean boost pumps 30, and provide clean boost fluid in line 31 exiting therefrom. A portion of the clean boost fluid (e.g., clean fluid 44 for combination with the concentrated slurry 45) can be provided from clean boost apparatus 35, while a portion of clean boost 36 can be introduced to a manifold 124 (FIG. 6) (e.g., a clean manifold 124 or a clean side of a manifold 124) of manifold trailer 80. The concentrated slurry 45 and the clean fluid 44 boost utilized to provide the proppant slurry 47 can be combined with the concentrated slurry 45 downstream from discharge header 46, within discharge header 46 (as depicted by dotted line 44), prior to introduction into manifold 124 of manifold trailer 80, or within a manifold 124 of manifold trailer 80. In such embodiments, the one or more outlets 48 of discharge header 46 can be for the removal of proppant slurry 47 from the slurry blender 40B. The clean boost 36 can be introduced to a same or a different manifold 124 or manifold trailer 50 than the concentrated slurry 45, the proppant slurry 47, or the clean fluid 44. A flow meter FM4 can be positioned on clean boost line 31 upstream of separation of water in line 36 therefrom, as depicted in FIG. 3B. A portion of the water from water source 10 can thus be introduced via water suction lines 11B and a clean boost pump 30 via clean boost line 36 and/or a valve V1 to manifold trailer 80 and/or via clean line 36 to one or more clean hydraulic fracturing pumps 122 (FIG. 6 hereinbelow). As noted hereinabove with reference to FIG. 3A, concentrated slurry 45 in slurry line 43 can be produced in a mixer 70 via combination of proppant 18 with water/dilution fluid (e.g., introduced, for example, from water inlet line 11A via low pressure boost pump 20, water line 21A, and/or flow meter FM3)).

Controller 60 can be further configured to monitor a concentrated slurry pressure $P_{CS}$ of the concentrated slurry 45 in the concentrated slurry line 43 and a clean fluid pressure $P_{CF}$ of the clean fluid 44 in the clean fluid line 42, and control (e.g., a position of) a proportional valve 49 between the clean side 46B of the blender header 46 and the dirty side 46A of the blender header 46 to ensure that (e.g., only) clean fluid 44 (and not concentrated slurry 45) passes through the proportional valve 49. This can help ensure long life of the proportional valve 49. If the concentrated slurry flow rate is $Q_{CS}$ and the clean fluid flow rate is $Q_{CF}$, the total slurry flow rate of proppant slurry $Q_{TS}$ provided by the system can be depicted as $Q_{TS}=Q_{CS}+Q_{CF}$. For example, if the concentrated slurry flow rate $Q_{CS}$ is 60 bpm and the clean fluid flow rate (e.g., the "clean boost" provided by the clean fluid centrifugal pump 50B) $Q_{CF}$ is 40, then the combined flow rate of the proppant slurry 47 is 100 bpm. With reference to the example slurry pump 50A of FIG. 2A and FIG. 2B, such a slurry pump having a maximum POR of 60 bpm, the clean boost provided by the clean fluid pump 50B enables a total proppant slurry flow rate of 100 bpm, while still operating the slurry pump 50A within the POR.

The controller can control operation (e.g., of slurry blender 40A) such that the clean fluid pressure of the clean fluid 44 in the clean fluid line 42 is at least 5, 6, 7, 8, 9, 10, 11, 12, 13, 14, 15, 16, 17, 18, 19, or 20 psi (or at least 15, 20, 25, 30, or 35%) greater than the concentrated slurry pressure of the concentrated slurry 45 in the concentrated slurry line 43 (e.g., such that only clean fluid 44 passes through the proportional valve 49). The controller 60 can thus have a rate control function to slave the clean rate $Q_{CF}$ to the concentrated slurry rate $Q_{CS}$.

In embodiments, such as the embodiment of FIG. 3A, slurry pump 50A, clean pump 50B, and the blender header 46 are positioned on a (e.g., same) apparatus (e.g., a mobile unit, trailer or skid(s)).

As noted hereinabove, the blending system of this disclosure can include a flow meter FM1 on the concentrated slurry line 43, a flow meter FM2 on the clean fluid line 42, a pressure transducer T1 (FIG. 4) on the concentrated slurry line 43, and a pressure transducer T2 (FIG. 4) on the clean fluid line 42. The controller 60 can be in communication with the flow meter FM1, the flow meter FM2, the transducer T1, and/or the transducer T2, and can receive concentrated slurry flow rate $Q_{CS}$ information from the flow meter FM1 on the concentrated slurry line 43, clean fluid flow rate $Q_{CF}$ information from the flow meter FM2 on the clean fluid line 42, concentrated slurry pressure $P_{CS}$ information from the pressure transducer T1 on the concentrated slurry line 43, and clean fluid pressure $P_{CF}$ information from the transducer T2 on the clean fluid line 42 to control operation of the slurry blender 40A/blending system IA/IB.

The system can further include a manifold 124 (e.g., of a manifold trailer 50 downstream from the blender 40A/40B) configured to feed the proppant slurry 47 to one or more (e.g., "dirty") hydraulic fracturing pumps 122. As mentioned hereinabove, the manifold 124 can be configured to receive: (a) the concentrated slurry 45 and the clean fluid 44, or (b) the proppant slurry 47 (e.g., from the blender 40A/40B, the slurry pump 50A, the clean pump 50B, and/or clean boost apparatus 35).

Figure 5:
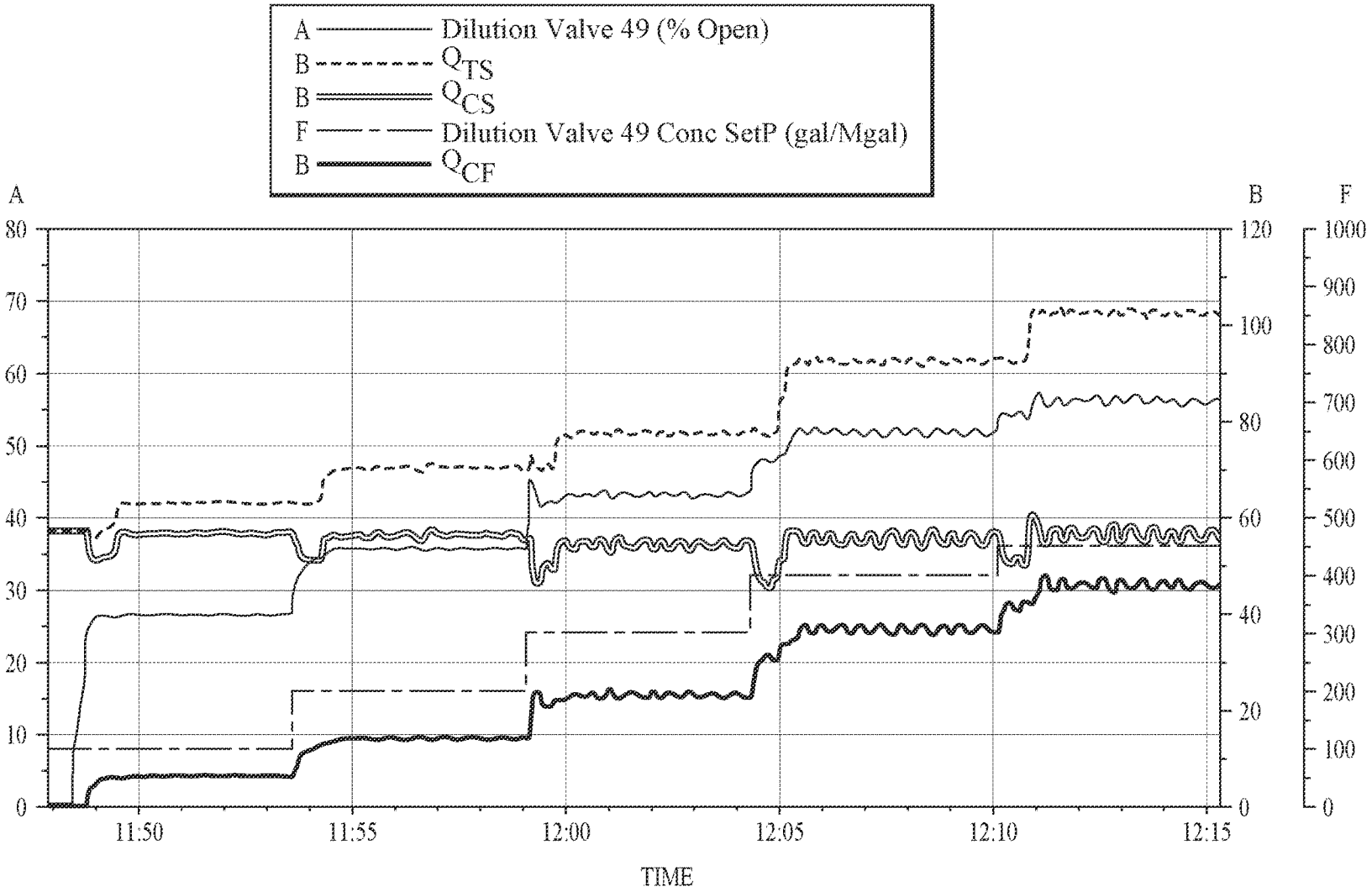
FIG. 5 is a representative graph of performance as a function of time during an example proppant slurry blending operation, according to embodiments of this disclosure.
Figure 9:
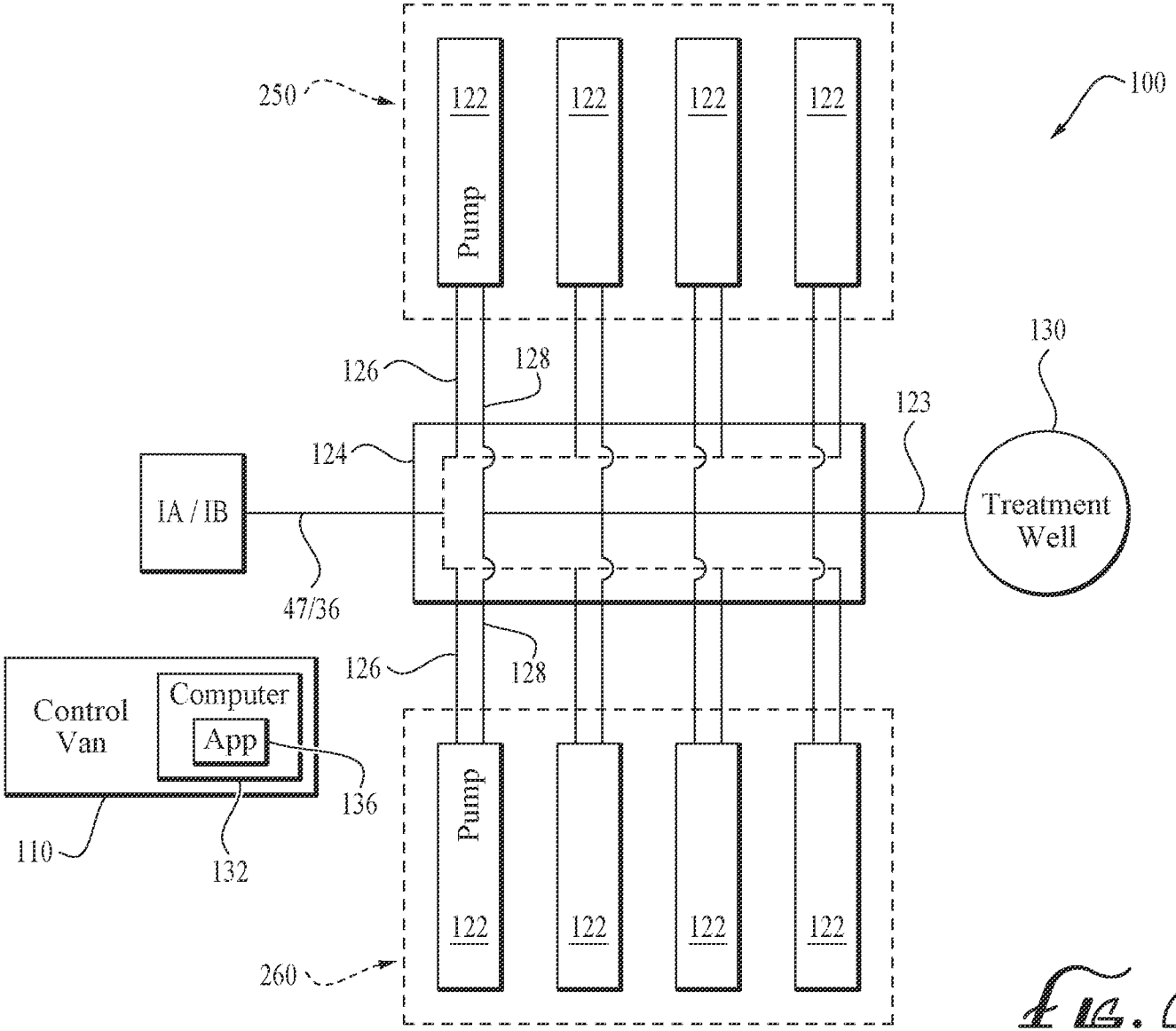

FIG. 5 is a representative graph of performance as a function of time during an example proppant slurry blending operation utilizing the pump described in FIG. 1, FIG. 2A and FIG. 2B. For this example operation, the concentrated slurry pump rate $Q_{CS}$ was established at 60 bpm, the pump BEP flow rate. At this point, the total slurry rate $Q_{TS}$ from the unit was 60 bpm, as shown by the "selected dirty rate" $Q_{TS}$ line. To increase the total slurry rate $Q_{TS}$, the clean fluid rate $Q_{CF}$ of clean fluid 44 ("clean discharge pump rate" $Q_{CF}$ line in FIG. 5) was metered into the slurry pump 50A discharge stream comprising the concentrated slurry 45 at various rate steps ("Dilution Valve 49 Conc SetP" line in FIG. 5) until the total slurry rate $Q_{TS}$ from the unit was 100 bpm, while maintaining the slurry pump 50A at its BEP, 60 bpm. As the dilution/proportional valve 49 is opened ("Dilution Valve 49 % Open" in FIG. 5) via the various rate steps ("Dilution Valve 49 Conc SetP" line in FIG. 5), additional clean fluid 44 (e.g., $Q_{CF}$ line in FIG. 5) is combined with the concentrated slurry 45 (e.g., $Q_{CS}$ line in FIG. 5) to provide the total proppant slurry 47 (e.g., $Q_{TS}$ in FIG. 5). Operation in this manner can be utilized to increase the capability of the unit blending unit/system, minimize slurry pump 50A wear, and can potentially allow for decreasing the size of the slurry pump 50A in applications requiring less total slurry rate $Q_{TS}$.

Reference will now be made to FIG. 6, which is a block diagram of a hydraulic fracturing system 100 treating one well 130, the hydraulic fracturing system 100 comprising a blending system IA/IB of this disclosure. In embodiments, the blending system comprises a slurry blender 40A or slurry blender 40B, as described hereinabove.

In embodiments, the proppant slurry 47 provided as described hereinabove with reference to FIG. 3A, FIG. 3B, and/or FIG. 4, can be introduced into a fracturing manifold 124 fluidly connected with one or more (e.g., high pressure) fracturing pumps 122 configured to introduce a fracturing fluid (e.g., a "dirty" fluid comprising proppant) 123 into a (e.g., first) well 130. Although not depicted in the embodiment of FIG. 6, the proppant slurry 47 can be combined with clean fluid (e.g., from a clean manifold 124) prior to introduction into well 130 and/or the proppant slurry 47 can be introduced into more than one manifold 124 for introduction into a plurality of wells 130. Furthermore, the proppant slurry 47 or a treatment fluid 123 comprising or consisting essentially of same can be introduced to more than one well 130, in embodiments.

FIG. 6 depicts the proppant slurry 47 (and/or clean fluid in clean line 36) being introduced into a manifold 124, wherein low pressure lines 126 introduce the fluid into the high pressure fracturing pumps 122, and high pressure fluid is returned via high pressure lines 128 to line 123 for introduction into the well 130 for treatment. As depicted, the pumping capacity of the fracturing fleet can be divided into a dirty fluid group 250 and a clean fluid group 260.

Frac pumps 122 can be high pressure (e.g., positive displacement) pumps, while slurry pump 50A, clean fluid pump 50B/clean boost pump 30 can be low pressure (e.g., centrifugal) pumps.

The hydraulic fracturing system 100 of FIG. 6 can be utilized to pump hydraulic fracturing fluids 123 into a wellbore 130, is illustrated. As depicted, a plurality of hydraulic fracturing pumps 122 (also referred to as "frac pump" or high horsepower pumps) can be connected in parallel to a fracturing manifold 124 (also referred to as a "missile") to provide fracturing fluids 123 to the treatment well 130 (also referred to as the wellhead). The fracturing fluids (e.g., pumped into well(s) 130 via line 123) are typically a blend of friction reducer and water, e.g., slick water, and proppant, although any fracturing or treatment fluid comprising proppant can be introduced into one or more wells 130 according to this disclosure.

The blending system IA/IB is in fluid communication with the manifold 124 so that the fracturing treatment is pumped into the manifold 124 for distribution to the frac pumps 122, via (e.g., low pressure) supply line 126. The fracturing fluids are returned to the manifold 124 from the frac pumps 122, via high pressure line 128, to be pumped into the treatment well 130 that is in fluid communication with the manifold 124. Although fracturing fluids typically contain a proppant, a portion of the pumping sequence may include a fracturing fluid without proppant (sometimes referred to as a pad fluid or a flush fluid herein). Although fracturing fluids typically include a gelled fluid, the fracturing fluid may be blended without a gelling chemical. Alternatively, the fracturing fluids can be blended with an acid to produce an acid fracturing fluid, for example, pumped as part of a spearhead or acid stage that clears debris that may be present in the wellbore and/or fractures to help clear the way for fracturing fluid to access the fractures and surrounding formation.

A control van 110 can be communicatively coupled (e.g., via a wired or wireless network) to any of the frac units wherein the term "frac units" may refer to any of the plurality of frac pumps 122, a manifold 124, a blending system IA/IB, etc. The managing application 136 executing on a computer (e.g., server) 132 within the control van 110 can establish unit level control over the frac units communicated via the network. Unit level control can include sending instructions to the frac units and/or receiving equipment data from the frac units. For example, the managing application 136 within the control van 110 can establish a pump rate of 25 bpm with the plurality of frac pumps 122 while receiving pressure and rate of pump crank revolutions from sensors on the frac pumps 122. The control van 110 can comprise controller 60 described above for controlling operation of blending system IA/IB, or they can be separate controllers. In embodiments, control van or controller 110 can include controller 60 controlling blending system IA/IB.

Although the managing application 136 is described as executing on a computer 132, it is understood that the computer 132 can be a computer system, for example computer system 380 in FIG. 10, or any form of a computer system such as a server, a workstation, a desktop computer, a laptop computer, a tablet computer, a smartphone, or any other type of computing device. The computer 132 (e.g., computer system) can include one or more processors, memory, input devices, and output devices, as described in more detail further hereinafter. Although the control van 110 is described as having the managing application 136 executing on a computer 132, it is understood that the control van 110 can have 2, 3, 4, or any number of computers 132 (e.g., computer systems) with 2, 3, 4, or any number of managing applications 136 executing on the computers 132.

A method of this disclosure can comprise: (operating a blender IA/IB/slurry blender 40A to provide) providing a total flow rate $Q_{TS}$ of a proppant slurry 47 by: utilizing a slurry pump 50A to provide a concentrated slurry flow rate $Q_{CS}$ of a concentrated slurry 45, wherein the concentrated slurry 45 has a higher concentration of a proppant 18 than the proppant slurry 47, wherein the total flow rate of the proppant slurry $Q_{TS}$ is greater than a maximum slurry pump flow rate of a preferred operating range (POR) of the slurry pump (e.g., is greater than the maximum POR flow rate of the slurry pump 50A), and wherein the concentrated slurry flow rate $Q_{CS}$ is less than or equal to the maximum slurry pump flow rate (e.g., the maximum POR flow rate); and utilizing a clean fluid pump 50B (e.g., to augment the concentrated slurry pump rate $Q_{CS}$) to provide a clean pump flow rate $Q_{CF}$ of a clean fluid 44, wherein the clean fluid 44 is substantially proppant-free; and combining the clean pump 50B flow rate $Q_{CF}$ of the clean fluid 44 with the concentrated slurry flow rate $Q_{CS}$ of the concentrated slurry 45 to provide the total pump flow rate $Q_{TS}$ of the proppant slurry 47.

The method can further comprise determining the maximum slurry pump flow rate (e.g., the maximum POR flow rate) by: determining a wear service class of the concentrated slurry 45; finding or estimating a best efficiency point (BEP) flow rate of the slurry pump 50A being utilized to provide the concentrated slurry 45; finding or estimating, as a percentage of the BEP flow rate, a (e.g., manufacturer recommended) preferred operating range (POR) of the slurry pump 50A being utilized to pump the concentrated slurry 45 in the wear service class, from a minimum recommended percentage of the BEP flow rate to a maximum recommended percentage of the BEP flow rate; and calculating the maximum pump slurry flow rate (e.g., the maximum POR flow rate) by multiplying the maximum recommended percentage of the POR by the BEP flow rate.

The method can further comprise maintaining the concentrated slurry flow rate $Q_{CS}$ below the maximum slurry pump flow rate $Q_{TS}$. In embodiments, for example, the method can comprise maintaining the concentrated slurry flow rate $Q_{CS}$ just below (e.g., within 1, 2, 3, 4, 5, 6, 7, 8, 9, 10, 15, or 20% of) the maximum slurry pump flow rate $Q_{TS}$. The method can further include determining the minimum pump slurry flow rate (e.g., the minimum POR flow rate) by multiplying the minimum recommended percentage of the POR by the BEP flow rate, and maintaining operation of the slurry pump 50A such that the concentrated slurry flow rate $Q_{CS}$ discharged therefrom remains at or above (e.g., within 1, 2, 3, 4, 5, 6, 7, 8, 9, 10, 15, or 20% of) the minimum POR flow rate.

Combining the clean pump flow rate $Q_{CF}$ of the clean fluid 44 with the concentrated slurry flow rate $Q_{CS}$ of the concentrated slurry 45 to provide the total pump flow rate $Q_{TS}$ of the proppant slurry 47 can further comprise providing the concentrated slurry 45 and the clean fluid 44 to a blender header 46 and extracting the proppant slurry 47 from (e.g., one or more discharge hoses fluidly connected to) the blender header 46. As noted hereinabove, the slurry pump 50A, the clean pump 50B, and the blender header 46 can be positioned on a (e.g., same or one or more different) mobile blender apparatus (e.g., a blender trailer or skid(s)).

Providing the concentrated slurry 45 and the clean fluid 44 to the blender header 46 can further comprise introducing the clean fluid 44 from a clean side 46B of the blender header 46 and via a proportional valve 49 to a dirty side 46A of the blender header 46. The proportional valve (e.g., "proportional control valve") 49 can combine the clean fluid 44 as a proportion of the concentrated slurry 45. For example, the clean fluid 44 can be combined as 10, 20, 30, 40, 50, 60%, or more of the concentrated slurry 45 to provide the proppant slurry 47. In embodiments, the fluid flow can be limited by the maximum rate of the clean pump and the proppant rate in the slurry.

The method can further comprise maintaining the clean fluid 44 at or above a clean fluid pressure $P_{CF}$ that is at least 5, 6, 7, 8, 9, 10, 11, 12, 13, 14, 15, 16, 17, 18, 19, or 20 psi (or at least 15, 20, 25, 30, or 35%) greater than a concentrated slurry pressure $P_{CS}$ of the concentrated slurry 45 (such that only clean fluid 44 passes through the proportional valve 49).

Providing the concentrated slurry 45 and the clean fluid 44 to the blender header 46 can further comprise providing the concentrated slurry 45 to the blender header 46 from the slurry pump 50A via a concentrated slurry flow line 43 and providing the clean fluid 44 from the clean fluid pump 50B (e.g., clean boost apparatus 35/clean boost pump 30) to the blender header 46 via a clean fluid flow line 42. The method can further comprise utilizing a control system 60 to monitor the concentrated slurry flow rate $Q_{CS}$ in the concentrated slurry line 43 and the clean fluid flow rate $Q_{CF}$ of the clean fluid 44 in the clean fluid line 42, the concentrated slurry pressure $P_{CS}$ and the clean fluid pressure $P_{CF}$, and control (e.g., a speed of) the concentrated slurry pump 50A, (e.g., a speed of) the clean fluid pump 50B, and (e.g., a position of) the proportional valve 49 to provide the proppant slurry 47 having the total flow rate $Q_{TS}$. The slurry pump 50A and the clean pump 50B can be positioned on a (e.g., same or different) apparatus (e.g., a mobile blender apparatus (e.g., a blender trailer or skid(s))).

Combining the clean pump flow rate $Q_{CF}$ of the clean fluid 44 with the concentrated slurry flow rate $Q_{CS}$ of the concentrated slurry 45 to provide the total pump flow rate $Q_{TS}$ of the proppant slurry 47 can further comprise providing the concentrated slurry 45 and the clean fluid 44, separately or in combination as the proppant slurry 47, to a manifold 124 (e.g., of a manifold trailer 80) configured to feed the proppant slurry 47 to one or more (e.g., "dirty") hydraulic fracturing pumps 122.

The method can further comprise introducing the proppant slurry 47 downhole in a hydraulic fracturing operation.

In embodiments, a method of providing a total flow rate $Q_{TS}$ of a proppant slurry 47 comprising a proppant 18, according to this disclosure comprises: determining a maximum (e.g., a preferred operating) slurry pump 50A flow rate for minimizing wear (e.g., a maximum POR flow rate) on a slurry pump 50A pumping a concentrated slurry 45 by: determining a wear service class of the concentrated slurry 45; finding or estimating a best efficiency point (BEP) flow rate of the slurry pump 50A being utilized to provide the concentrated slurry 45; finding or estimating, as a percentage of the BEP, a (e.g., manufacturer recommended) preferred operating range (POR) of the slurry pump 50A being utilized to pump the concentrated slurry 45 in the wear service class, from a minimum recommended percentage of the BEP flow rate to a maximum recommended percentage of the BEP flow rate; and calculating the maximum pump slurry flow rate (e.g., the maximum POR flow rate) by multiplying the maximum recommended percentage of the POR by the BEP flow rate; and combining a clean pump flow rate $Q_{CF}$ of a clean fluid 44 from a clean fluid pump 50B with a concentrated slurry flow rate $Q_{CS}$ of the concentrated slurry 45 from the slurry pump 50A to provide the total pump flow rate $Q_{TS}$ of the proppant slurry 47, wherein the concentrated slurry 45 has a higher concentration of the proppant 18 than the proppant slurry 47, wherein the total flow rate $Q_{TS}$ of the proppant slurry 47 is greater than the maximum slurry pump flow rate (e.g., the maximum POR flow rate) of the slurry pump 50A, wherein the concentrated slurry flow rate $Q_{CS}$ is less than the maximum slurry pump flow rate (e.g., the maximum POR flow rate), and wherein the clean fluid 44 is substantially proppant-free.

The method can further comprise maintaining the concentrated slurry flow rate $Q_{CS}$ (e.g., just) below (e.g., within 1, 2, 3, 4, 5, 6, 7, 8, 9, 10, 15, or 20% of) the maximum slurry pump flow rate (e.g., the maximum POR flow rate).

Combining the clean pump flow rate $Q_{CF}$ of the clean fluid 44 with the concentrated slurry flow rate $Q_{CS}$ of the concentrated slurry 45 to provide the total pump flow rate $Q_{TS}$ of the proppant slurry 47 can further comprise providing the concentrated slurry 45 and the clean fluid 44 to a blender header 46 and extracting the proppant slurry 47 from (e.g., one or more discharge hoses fluidly connected to) the blender header 46.

Providing the concentrated slurry 45 and the clean fluid 44 to the blender header 46 can further comprise introducing the clean fluid 44 from a clean side 46B of the blender header 46 and via a proportional valve 49 to a dirty side 46A of the blender header 46. Introducing the clean fluid 44 from the clean side 46B of the blender header 46 and via the proportional valve 49 to the dirty side 46A of the blender header 46 can further comprise introducing the clean fluid 44 at a clean fluid pressure $P_{CF}$ that is at least 5, 6, 7, 8, 9, 10, 11, 12, 13, 14, 15, 16, 17, 18, 19, or 20 psi (or at least 15, 20, 25, 30, or 35%) greater than a concentrated slurry pressure $P_{CS}$ of the concentrated slurry 45 (e.g., such that only clean fluid 44 passes through the proportional valve 49).

Providing the concentrated slurry 45 and the clean fluid 44 to the blender header 46 can further comprise providing the concentrated slurry 45 to the blender header 46 from the slurry pump 50A via a concentrated slurry flow line 43 and providing the clean fluid 44 from the clean fluid pump 50B to the blender header 46 via a clean fluid flow line 42. The method can further comprise utilizing a control system 60 to monitor the concentrated slurry flow rate $Q_{CS}$ in the concentrated slurry line 43 and the clean fluid flow rate $Q_{CF}$ of the clean fluid 44 in the clean fluid line 42, the concentrated slurry pressure $P_{CS}$ (e.g., in the concentrated slurry line 43/concentrated slurry 45 on the dirty side 46A of the header 46), and the clean fluid pressure $Q_{CF}$ (e.g., in the clean fluid line 42/clean fluid 44 on the clean side 46B of the blender header 46), and control (e.g., a speed of) the concentrated slurry pump 50A, (e.g., a speed of) the clean fluid pump 50B, and (e.g., a position of) the proportional valve 49 to provide the proppant slurry 47 having the total flow rate $Q_{TS}$.

Figure 7:
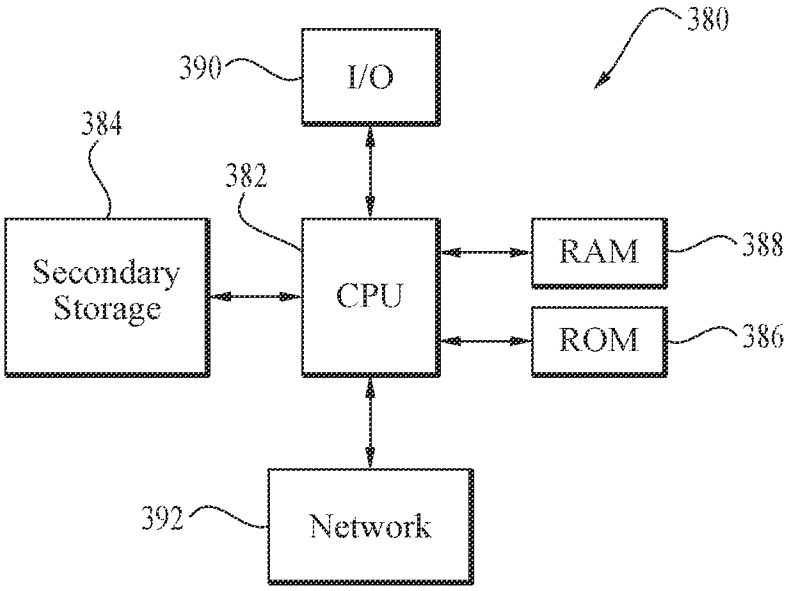
FIG. 7 is a block diagram of a computer system according to embodiments of the disclosure.

FIG. 7 illustrates a computer system 380 suitable for implementing one or more embodiments disclosed herein, for example implementing one or more computers, servers or the like as disclosed or used herein, including without limitation any aspect of the computing system associated with controller 30 or control van 110 (e.g., computer 132). The computer system 380 includes a processor 382 (which may be referred to as a central processor unit or CPU) that is in communication with memory devices including secondary storage 384, read only memory (ROM) 386, random access memory (RAM) 388, input/output (I/O) devices 390, and network connectivity devices 392. The processor 382 may be implemented as one or more CPU chips.

It is understood that by programming and/or loading executable instructions onto the computer system 380, at least one of the CPU 382, the RAM 388, and the ROM 386 are changed, transforming the computer system 380 in part into a particular machine or apparatus having the novel functionality taught by the present disclosure. It is fundamental to the electrical engineering and software engineering arts that functionality that can be implemented by loading executable software into a computer can be converted to a hardware implementation by well-known design rules. Decisions between implementing a concept in software versus hardware typically hinge on considerations of stability of the design and numbers of units to be produced rather than any issues involved in translating from the software domain to the hardware domain. Generally, a design that is still subject to frequent change may be preferred to be implemented in software, because re-spinning a hardware implementation is more expensive than re-spinning a software design. Generally, a design that is stable that will be produced in large volume may be preferred to be implemented in hardware, for example in an application specific integrated circuit (ASIC), because for large production runs the hardware implementation may be less expensive than the software implementation. Often a design may be developed and tested in a software form and later transformed, by well-known design rules, to an equivalent hardware implementation in an application specific integrated circuit that hardwires the instructions of the software. In the same manner as a machine controlled by a new ASIC is a particular machine or apparatus, likewise a computer that has been programmed and/or loaded with executable instructions may be viewed as a particular machine or apparatus.

Additionally, after the computer system 380 is turned on or booted, the CPU 382 may execute a computer program or application. For example, the CPU 382 may execute software or firmware stored in the ROM 386 or stored in the RAM 388. In some cases, on boot and/or when the application is initiated, the CPU 382 may copy the application or portions of the application from the secondary storage 384 to the RAM 388 or to memory space within the CPU 382 itself, and the CPU 382 may then execute instructions that the application is comprised of. In some cases, the CPU 382 may copy the application or portions of the application from memory accessed via the network connectivity devices 392 or via the I/O devices 390 to the RAM 388 or to memory space within the CPU 382, and the CPU 382 may then execute instructions that the application is comprised of. During execution, an application may load instructions into the CPU 382, for example load some of the instructions of the application into a cache of the CPU 382. In some contexts, an application that is executed may be said to configure the CPU 382 to do something, e.g., to configure the CPU 382 to perform the function or functions promoted by the subject application. When the CPU 382 is configured in this way by the application, the CPU 382 becomes a specific purpose computer or a specific purpose machine.

The secondary storage 384 is typically comprised of one or more disk drives or tape drives and is used for non-volatile storage of data and as an over-flow data storage device if RAM 388 is not large enough to hold all working data. Secondary storage 384 may be used to store programs which are loaded into RAM 388 when such programs are selected for execution. The ROM 386 is used to store instructions and perhaps data which are read during program execution. ROM 386 is a non-volatile memory device which typically has a small memory capacity relative to the larger memory capacity of secondary storage 384. The RAM 388 is used to store volatile data and perhaps to store instructions. Access to both ROM 386 and RAM 388 is typically faster than to secondary storage 384. The secondary storage 384, the RAM 388, and/or the ROM 386 may be referred to in some contexts as computer readable storage media and/or non-transitory computer readable media.

I/O devices 390 may include printers, video monitors, liquid crystal displays (LCDs), touch screen displays, keyboards, keypads, switches, dials, mice, track balls, voice recognizers, card readers, paper tape readers, or other well-known input devices.

The network connectivity devices 392 may take the form of modems, modem banks, Ethernet cards, universal serial bus (USB) interface cards, serial interfaces, token ring cards, fiber distributed data interface (FDDI) cards, wireless local area network (WLAN) cards, radio transceiver cards, and/or other well-known network devices. The network connectivity devices 392 may provide wired communication links and/or wireless communication links (e.g., a first network connectivity device 392 may provide a wired communication link and a second network connectivity device 392 may provide a wireless communication link). Wired communication links may be provided in accordance with Ethernet (IEEE 802.3), Internet protocol (IP), time division multiplex (TDM), data over cable service interface specification (DOCSIS), wavelength division multiplexing (WDM), and/or the like. In an embodiment, the radio transceiver cards may provide wireless communication links using protocols such as code division multiple access (CDMA), global system for mobile communications (GSM), long-term evolution (LTE), WiFi (IEEE 802.11), Bluetooth, Zigbee, narrowband Internet of things (NB IoT), near field communications (NFC), radio frequency identity (RFID). The radio transceiver cards may promote radio communications using 5G, 5G New Radio, or 5G LTE radio communication protocols. These network connectivity devices 392 may enable the processor 382 to communicate with the Internet or one or more intranets. With such a network connection, it is contemplated that the processor 382 might receive information from the network, or might output information to the network in the course of performing the above-described method steps. Such information, which is often represented as a sequence of instructions to be executed using processor 382, may be received from and outputted to the network, for example, in the form of a computer data signal embodied in a carrier wave.

Such information, which may include data or instructions to be executed using processor 382 for example, may be received from and outputted to the network, for example, in the form of a computer data baseband signal or signal embodied in a carrier wave. The baseband signal or signal embedded in the carrier wave, or other types of signals currently used or hereafter developed, may be generated according to several methods well-known to one skilled in the art. The baseband signal and/or signal embedded in the carrier wave may be referred to in some contexts as a transitory signal.

The processor 382 executes instructions, codes, computer programs, scripts which it accesses from hard disk, floppy disk, optical disk (these various disk based systems may all be considered secondary storage 384), flash drive, ROM 386, RAM 388, or the network connectivity devices 392. While only one processor 382 is shown, multiple processors may be present. Thus, while instructions may be discussed as executed by a processor, the instructions may be executed simultaneously, serially, or otherwise executed by one or multiple processors. Instructions, codes, computer programs, scripts, and/or data that may be accessed from the secondary storage 384, for example, hard drives, floppy disks, optical disks, and/or other device, the ROM 386, and/or the RAM 388 may be referred to in some contexts as non-transitory instructions and/or non-transitory information.

In an embodiment, the computer system 380 may comprise two or more computers in communication with each other that collaborate to perform a task. For example, but not by way of limitation, an application may be partitioned in such a way as to permit concurrent and/or parallel processing of the instructions of the application. Alternatively, the data processed by the application may be partitioned in such a way as to permit concurrent and/or parallel processing of different portions of a data set by the two or more computers. In an embodiment, virtualization software may be employed by the computer system 380 to provide the functionality of a number of servers that is not directly bound to the number of computers in the computer system 380. For example, virtualization software may provide twenty virtual servers on four physical computers. In an embodiment, the functionality disclosed above may be provided by executing the application and/or applications in a cloud computing environment. Cloud computing may comprise providing computing services via a network connection using dynamically scalable computing resources. Cloud computing may be supported, at least in part, by virtualization software. A cloud computing environment may be established by an enterprise and/or may be hired on an as-needed basis from a third party provider. Some cloud computing environments may comprise cloud computing resources owned and operated by the enterprise as well as cloud computing resources hired and/or leased from a third party provider.

In an embodiment, some or all of the functionality disclosed above may be provided as a computer program product. The computer program product may comprise one or more computer readable storage medium having computer usable program code embodied therein to implement the functionality disclosed above. The computer program product may comprise data structures, executable instructions, and other computer usable program code. The computer program product may be embodied in removable computer storage media and/or non-removable computer storage media. The removable computer readable storage medium may comprise, without limitation, a paper tape, a magnetic tape, magnetic disk, an optical disk, a solid state memory chip, for example analog magnetic tape, compact disk read only memory (CD-ROM) disks, floppy disks, jump drives, digital cards, multimedia cards, and others. The computer program product may be suitable for loading, by the computer system 380, at least portions of the contents of the computer program product to the secondary storage 384, to the ROM 386, to the RAM 388, and/or to other non-volatile memory and volatile memory of the computer system 380. The processor 382 may process the executable instructions and/or data structures in part by directly accessing the computer program product, for example by reading from a CD-ROM disk inserted into a disk drive peripheral of the computer system 380. Alternatively, the processor 382 may process the executable instructions and/or data structures by remotely accessing the computer program product, for example by downloading the executable instructions and/or data structures from a remote server through the network connectivity devices 392. The computer program product may comprise instructions that promote the loading and/or copying of data, data structures, files, and/or executable instructions to the secondary storage 384, to the ROM 386, to the RAM 388, and/or to other non-volatile memory and volatile memory of the computer system 380.

In some contexts, the secondary storage 384, the ROM 386, and the RAM 388 may be referred to as a non-transitory computer readable medium or a computer readable storage media. A dynamic RAM embodiment of the RAM 388, likewise, may be referred to as a non-transitory computer readable medium in that while the dynamic RAM receives electrical power and is operated in accordance with its design, for example during a period of time during which the computer system 380 is turned on and operational, the dynamic RAM stores information that is written to it. Similarly, the processor 382 may comprise an internal RAM, an internal ROM, a cache memory, and/or other internal non-transitory storage blocks, sections, or components that may be referred to in some contexts as non-transitory computer readable media or computer readable storage media.

The herein disclosed system and method allow for reduced capital costs via the use of smaller slurry pumps 50A, less slurry pump wear, lower maintenance cost, and/or wider equipment operating ranges. The system and method of this disclosure can provide an increased total proppant slurry 47 discharge rate $Q_{TS}$ with a slurry pump 50A operated within the POR, by augmenting a concentrated slurry flow rate $Q_{CS}$ with a clean fluid discharge rate (or "boost") $Q_{CS}$ from a clean fluid pump 50B.

The herein disclosed system and method can provide for increased operating life and reduced non-productive time (NPT) of frac blending equipment.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

ADDITIONAL DISCLOSURE

The following are non-limiting, specific embodiments in accordance with the present disclosure:

In a first embodiment, a method comprises: (e.g., operating a blender to provide) providing a total flow rate of a proppant slurry by: utilizing a slurry pump (of the blender) to provide a concentrated slurry flow rate of a concentrated slurry, wherein the concentrated slurry has a higher concentration of the proppant than the proppant slurry, wherein the total flow rate of the proppant slurry is greater than a maximum slurry pump flow rate of a preferred operating range (POR) of the slurry pump, and wherein the concentrated slurry flow rate is less than or equal to the maximum slurry pump flow rate; and utilizing a clean fluid pump (e.g., to augment the concentrated slurry pump rate) to provide a clean pump flow rate of a clean fluid, wherein the clean fluid is substantially proppant-free; and combining the clean pump flow rate of the clean fluid with the concentrated slurry flow rate of the concentrated slurry to provide the total pump flow rate of the proppant slurry.

A second embodiment can include the method of the first embodiment further comprising determining the maximum slurry pump flow rate by: determining a wear service class of the concentrated slurry; finding or estimating a best efficiency point (BEP) flow rate of the slurry pump being utilized to provide the concentrated slurry; finding or estimating, as a percentage of the BEP flow rate, a (e.g., manufacturer recommended) preferred operating range (POR) of the slurry pump being utilized to pump the concentrated slurry in the wear service class, from a minimum recommended percentage of the BEP flow rate to a maximum recommended percentage of the BEP flow rate; and calculating the maximum pump slurry flow rate by multiplying the maximum recommended percentage of the POR by the BEP flow rate.

A third embodiment can include the method of the first or second embodiment further comprising maintaining the concentrated slurry flow rate (e.g.) just below (e.g., within 1, 2, 3, 4, 5, 6, 7, 8, 9, 10, 15, or 20% of) the maximum slurry pump flow rate (e.g., maintaining the slurry pump rate above the BEP and/or maintaining the concentrated slurry flow rate within the POR of the slurry pump).

A fourth embodiment can include the method of any one of the first to third embodiments, wherein combining the clean pump flow rate of the clean fluid with the concentrated slurry flow rate of the concentrated slurry to provide the total pump flow rate of the proppant slurry further comprises providing the concentrated slurry and the clean fluid to a blender header and extracting the proppant slurry from (e.g., one or more discharge hoses fluidly connected to) the blender header.

A fifth embodiment can include the method of the fourth embodiment, wherein the slurry pump, the clean pump, and the blender header are positioned on a (e.g., same) mobile blender apparatus (e.g., a blender trailer or skid(s)).

A sixth embodiment can include the method of the fourth or fifth embodiment, wherein providing the concentrated slurry and the clean fluid to the blender header further comprises introducing the clean fluid from a clean side of the blender header and via a proportional valve to a dirty side of the blender header.

A seventh embodiment can include the method of the sixth embodiment further comprising maintaining the clean fluid at or above a clean fluid pressure that is at least 5, 6, 7, 8, 9, 10, 11, 12, 13, 14, 15, 16, 17, 18, 19, or 20 psi (or at least 15, 20, 25, 30, or 35%) greater than a concentrated slurry pressure of the concentrated slurry (such that only clean fluid passes through the proportional valve).

An eighth embodiment can include the method of the sixth or seventh embodiment, wherein providing the concentrated slurry and the clean fluid to the blender header further comprises providing the concentrated slurry to the blender header from the slurry pump via a concentrated slurry flow line and providing the clean fluid from the clean fluid pump to the blender header via a clean fluid flow line, and wherein the method further comprises utilizing a control system to monitor the concentrated slurry flow rate in the concentrated slurry line and the clean fluid flow rate of the clean fluid in the clean fluid line, the concentrated slurry pressure and the clean fluid pressure, and control a speed of the concentrated slurry pump, a speed of the clean fluid pump, and a position of the proportional valve to provide the proppant slurry having the total flow rate.

A ninth embodiment can include the method of any one of the first to eighth embodiments, wherein the slurry pump and the clean pump are positioned on a (e.g., same or different) mobile blender apparatus (e.g., a blender trailer or skid(s)).

A tenth embodiment can include the method of any one of the first to ninth embodiments, wherein combining the clean pump flow rate of the clean fluid with the concentrated slurry flow rate of the concentrated slurry to provide the total pump flow rate of the proppant slurry further comprises providing the concentrated slurry and the clean fluid, separately or in combination as the proppant slurry, to a manifold (e.g., trailer) configured to feed the proppant slurry to one or more (e.g., "dirty") hydraulic fracturing pumps.

An eleventh embodiment can include the method of any one of the first to tenth embodiments further comprising introducing the proppant slurry downhole in a hydraulic fracturing operation.

In a twelfth embodiment, a method of providing a total flow rate of a proppant slurry comprising a proppant comprises: determining a maximum (e.g., a preferred operating) slurry pump flow rate for minimizing wear on a slurry pump pumping a concentrated slurry by: determining a wear service class of the concentrated slurry; finding or estimating a best efficiency point (BEP) flow rate of the slurry pump being utilized to provide the concentrated slurry; finding or estimating, as a percentage of the BEP, a (e.g., manufacturer recommended) preferred operating range (POR) of the slurry pump being utilized to pump the concentrated slurry in the wear service class, from a minimum recommended percentage of the BEP flow rate to a maximum recommended percentage of the BEP flow rate; and calculating the maximum pump slurry flow rate by multiplying the maximum recommended percentage of the POR by the BEP flow rate; and combining (e.g., downstream of the slurry pump) a clean pump flow rate of a clean fluid from a clean fluid pump with a concentrated slurry flow rate of the concentrated slurry from the slurry pump to provide the total pump flow rate of the proppant slurry, wherein the concentrated slurry has a higher concentration of the proppant than the proppant slurry, wherein the total flow rate of the proppant slurry is greater than the maximum slurry pump flow rate of the slurry pump, wherein the concentrated slurry flow rate is less than the maximum slurry pump flow rate, and wherein the clean fluid is substantially proppant-free.

A thirteenth embodiment can include the method of the twelfth embodiment further comprising maintaining the concentrated slurry flow rate (e.g., just) below (e.g., within 1, 2, 3, 4, 5, 6, 7, 8, 9, 10, 15, or 20% of) the maximum slurry pump flow rate.

A fourteenth embodiment can include the method of the twelfth or thirteenth embodiment, wherein combining the clean pump flow rate of the clean fluid with the concentrated slurry flow rate of the concentrated slurry to provide the total pump flow rate of the proppant slurry further comprises providing the concentrated slurry and the clean fluid to a blender header and extracting the proppant slurry from (e.g., one or more discharge hoses fluidly connected to) the blender header.

A fifteenth embodiment can include the method of the fourteenth embodiment, wherein providing the concentrated slurry and the clean fluid to the blender header further comprises introducing the clean fluid from a clean side of the blender header and via a proportional valve to a dirty side of the blender header.

A sixteenth embodiment can include the method of the fifteenth embodiment, wherein introducing the clean fluid from the clean side of the blender header and via the proportional valve to the dirty side of the blender header further comprises the clean fluid at a clean fluid pressure that is at least 5, 6, 7, 8, 9, 10, 11, 12, 13, 14, 15, 16, 17, 18, 19, or 20 psi (or at least 15, 20, 25, 30, or 35%) greater than a concentrated slurry pressure of the concentrated slurry (such that only clean fluid passes through the proportional valve).

A seventeenth embodiment can include the method of the sixteenth embodiment, wherein providing the concentrated slurry and the clean fluid to the blender header further comprises providing the concentrated slurry to the blender header from the slurry pump via a concentrated slurry flow line and providing the clean fluid from the clean fluid pump to the blender header via a clean fluid flow line, and wherein the method further comprises utilizing a control system to monitor the concentrated slurry flow rate in the concentrated slurry line and the clean fluid flow rate of the clean fluid in the clean fluid line, the concentrated slurry pressure, and the clean fluid pressure, and control a speed of the concentrated slurry pump, a speed of the clean fluid pump, and a position of the proportional valve to provide the proppant slurry having the total flow rate.

An eighteenth embodiment can include the method of any one of the twelfth to seventeenth embodiments, wherein the total flow rate of the proppant slurry is greater than the maximum slurry pump flow rate of the slurry pump.

In an nineteenth embodiment, a blending system for providing a total flow rate of a proppant slurry comprises: a slurry pump operable to provide a concentrated slurry in a concentrated slurry line, wherein the concentrated slurry has a higher concentration of a proppant than the proppant slurry; a clean fluid pump operable to provide a clean fluid in a clean fluid line, wherein the clean fluid is substantially proppant-free; and a control system configured to monitor a concentrated slurry flow rate of the concentrated slurry in the concentrated slurry line and a clean fluid flow rate of the clean fluid in the clean fluid line, and control (e.g., a speed of) the concentrated slurry pump and (e.g., a speed of) the clean fluid pump, such that combination of the concentrated slurry and the clean fluid provides the proppant slurry having the total flow rate, wherein the total flow rate of the proppant slurry is greater than a maximum slurry pump flow rate of a preferred operating range (POR) of the slurry pump, and wherein the concentrated slurry flow rate is less than or equal to the maximum slurry pump flow rate.

A twentieth embodiment can include the blender of the nineteenth embodiment further comprising a blender header fluidly connected to the concentrated slurry line and the clean fluid line, wherein the concentrated slurry line is fluidly connected with a dirty/slurry side of the blender header and wherein the clean fluid line is fluidly connected with another/clean side of the blender header, and wherein the blender header further comprises one or more outlets for extracting the proppant slurry therefrom, and wherein the controller is further configured to monitor a concentrated slurry pressure of the concentrated slurry in the concentrated slurry line and a clean fluid pressure of the clean fluid in the clean fluid line, and control (e.g., a position of) a proportional valve between the clean side of the blender header and the dirty side of the blender header to ensure that (e.g., only) clean fluid (e.g., and not concentrated slurry) passes through the proportional valve.

A twenty first embodiment can include the system of the nineteenth or twentieth embodiment, wherein the controller controls operation of the blender such that the clean fluid pressure of the clean fluid in the clean fluid line is at least 5, 6, 7, 8, 9, 10, 11, 12, 13, 14, 15, 16, 17, 18, 19, or 20 psi (or at least 15, 20, 25, 30, or 35%) greater than the concentrated slurry pressure of the concentrated slurry in the concentrated slurry line (such that only clean fluid passes through the proportional valve).

A twenty second embodiment can include the system of the twentieth or twenty first embodiment, wherein the slurry pump, the clean pump and the blender header are positioned on a (e.g., same) mobile blender apparatus (e.g., a blender trailer or skid(s)).

A twenty third embodiment can include the system of any one of the twentieth to twenty second embodiments further comprising a flow meter on the concentrated slurry line, a flow meter on the clean fluid line, a pressure transducer on the concentrated slurry line, and a pressure transducer on the clean fluid line, wherein the controller receives concentrated slurry flow rate information from the flow meter on the concentrated slurry line, clean fluid flow rate information from the flow meter on the clean fluid line, concentrated slurry pressure from the pressure transducer on the concentrated slurry line, and clean fluid pressure information from the transducer on the clean fluid line to control operation of the blending system.

A twenty fourth embodiment can include the system of any one of the nineteenth to twenty third embodiments, wherein the slurry pump and the clean pump are positioned on a (e.g., same or different) mobile blender apparatus (e.g., a blender trailer or skid(s)).

A twenty fifth embodiment can include the system of any one of the nineteenth to twenty fourth embodiments further comprising a manifold (e.g., a manifold trailer downstream from the blender) configured to feed the proppant slurry to one or more (e.g., "dirty") hydraulic fracturing pumps, wherein the manifold is configured to receive: (a) the concentrated slurry and the clean fluid, or (b) the proppant slurry from the blender.

A twenty sixth embodiment can include the system or method of any prior embodiment, wherein combining the clean pump flow rate of the clean fluid with the concentrated slurry flow rate of the concentrated slurry to provide the total pump flow rate of the proppant slurry is effected downstream of the slurry pump.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: $R=Rl+k*(Ru-Rl)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . 95 percent, 96 percent, 97 percent, 98 percent, 99 percent, or 100 percent. Moreover, any numerical range defined by two R numbers as defined in the above is also specifically disclosed. Use of broader terms such as comprises, includes, having, etc. should be understood to provide support for narrower terms such as consisting of, consisting essentially of, comprised substantially of, etc. When a feature is described as "optional," both embodiments with this feature and embodiments without this feature are disclosed. Similarly, the present disclosure contemplates embodiments where this "optional" feature is required and embodiments where this feature is specifically excluded.

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. The discussion of a reference herein is not an admission that it is prior art, especially any reference that can have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. A method comprising:

providing a total flow rate of a proppant slurry by:

utilizing a slurry pump to provide a concentrated slurry flow rate of a concentrated slurry, wherein the concentrated slurry has a higher concentration of the proppant than the proppant slurry, wherein the total flow rate of the proppant slurry is greater than a maximum slurry pump flow rate of a preferred operating range (POR) of the slurry pump, wherein the concentrated slurry flow rate is less than or equal to the maximum slurry pump flow rate, and wherein determining the maximum slurry pump flow rate comprises:

determining a wear service class of the concentrated slurry;

finding or estimating a best efficiency point (BEP) flow rate of the slurry pump being utilized to provide the concentrated slurry;

finding or estimating, as a percentage of the BEP flow rate, a preferred operating range (POR) of the slurry pump being utilized to pump the concentrated slurry in the wear service class, from a minimum recommended percentage of the BEP flow rate to a maximum recommended percentage of the BEP flow rate; and calculating the maximum pump slurry flow rate by multiplying the maximum recommended percentage of the POR by the BEP flow rate;

utilizing a clean fluid pump to provide a clean pump flow rate of a clean fluid, wherein the clean fluid is substantially proppant-free; and combining the clean pump flow rate of the clean fluid with the concentrated slurry flow rate of the concentrated slurry to provide the total pump flow rate of the proppant slurry.

2. The method of claim 1 further comprising maintaining the concentrated slurry flow rate below the maximum slurry pump flow rate, below the BEP, and/or within the POR of the slurry pump.

3. The method of claim 1, wherein combining the clean pump flow rate of the clean fluid with the concentrated slurry flow rate of the concentrated slurry to provide the total pump flow rate of the proppant slurry further comprises providing the concentrated slurry and the clean fluid to a blender header and extracting the proppant slurry from the blender header.

4. The method of claim 3, wherein providing the concentrated slurry and the clean fluid to the blender header further comprises introducing the clean fluid from a clean side of the blender header and via a proportional valve to a dirty side of the blender header.

5. The method of claim 4 further comprising maintaining the clean fluid at or above a clean fluid pressure that is at least 5 psi greater than a concentrated slurry pressure of the concentrated slurry.

6. The method of claim 4, wherein combining the clean pump flow rate of the clean fluid with the concentrated slurry flow rate of the concentrated slurry to provide the total pump flow rate of the proppant slurry further comprises providing the concentrated slurry from the slurry pump via a concentrated slurry flow line and providing the clean fluid from the clean fluid pump via a clean fluid flow line, and wherein the method further comprises utilizing a control system to monitor the concentrated slurry flow rate in the concentrated slurry line and the clean fluid flow rate of the clean fluid in the clean fluid line, the concentrated slurry pressure and the clean fluid pressure, and control a speed of the concentrated slurry pump, a speed of the clean fluid pump, and a position of the proportional valve to provide the proppant slurry having the total flow rate.

7. The method of claim 1, wherein combining the clean pump flow rate of the clean fluid with the concentrated slurry flow rate of the concentrated slurry to provide the total pump flow rate of the proppant slurry further comprises providing the concentrated slurry and the clean fluid, separately or in combination as the proppant slurry, to a manifold configured to feed the proppant slurry to one or more hydraulic fracturing pumps.

8. The method of claim 1 further comprising introducing the proppant slurry downhole in a hydraulic fracturing operation.

9. The method of claim 1, wherein the slurry pump, the clean fluid pump, and the blender header are positioned on a mobile blender apparatus.

10. A method of providing a total flow rate of a proppant slurry comprising a proppant, the method comprising:

determining a maximum slurry pump flow rate for minimizing wear on a slurry pump pumping a concentrated slurry by:

determining a wear service class of the concentrated slurry;

finding or estimating a best efficiency point (BEP) flow rate of the slurry pump being utilized to provide the concentrated slurry;

finding or estimating, as a percentage of the BEP, a preferred operating range (POR) of the slurry pump being utilized to pump the concentrated slurry in the wear service class, from a minimum recommended percentage of the BEP flow rate to a maximum recommended percentage of the BEP flow rate; and calculating the maximum pump slurry flow rate by multiplying the maximum recommended percentage of the POR by the BEP flow rate; and combining a clean pump flow rate of a clean fluid from a clean fluid pump with a concentrated slurry flow rate of the concentrated slurry from the slurry pump to provide the total pump flow rate of the proppant slurry, wherein the concentrated slurry has a higher concentration of the proppant than the proppant slurry, wherein the concentrated slurry flow rate is less than the maximum slurry pump flow rate, and wherein the clean fluid is substantially proppant-free.

11. The method of claim 10 further comprising maintaining the concentrated slurry flow rate below the maximum slurry pump flow rate.

12. The method of claim 10, wherein combining the clean pump flow rate of the clean fluid with the concentrated slurry flow rate of the concentrated slurry to provide the total pump flow rate of the proppant slurry further comprises providing the concentrated slurry and the clean fluid to a blender header and extracting the proppant slurry from the blender header.

13. The method of claim 12, wherein providing the concentrated slurry and the clean fluid to the blender header further comprises introducing the clean fluid from a clean side of the blender header and via a proportional valve to a dirty side of the blender header.

14. The method of claim 13, wherein introducing the clean fluid from the clean side of the blender header and via the proportional valve to the dirty side of the blender header further comprises the clean fluid at a clean fluid pressure that is at least 5 psi greater than a concentrated slurry pressure of the concentrated slurry.

15. The method of claim 14, wherein providing the concentrated slurry and the clean fluid to the blender header further comprises providing the concentrated slurry to the blender header from the slurry pump via a concentrated slurry flow line and providing the clean fluid from the clean fluid pump to the blender header via a clean fluid flow line, and wherein the method further comprises utilizing a control system to monitor the concentrated slurry flow rate in the concentrated slurry line and the clean fluid flow rate of the clean fluid in the clean fluid line, the concentrated slurry pressure, and the clean fluid pressure, and control a speed of the concentrated slurry pump, a speed of the clean fluid pump, and a position of the proportional valve to provide the proppant slurry having the total flow rate.

16. The method of claim 10, wherein the total flow rate of the proppant slurry is greater than the maximum slurry pump flow rate of the slurry pump.

17. A blending system for providing a total flow rate of a proppant slurry, the system comprising:

a slurry pump operable to provide a concentrated slurry in a concentrated slurry line, wherein the concentrated slurry has a higher concentration of a proppant than the proppant slurry;

a clean fluid pump operable to provide a clean fluid in a clean fluid line, wherein the clean fluid is substantially proppant-free;

a blender header fluidly connected to the concentrated slurry line and the clean fluid line, wherein the concentrated slurry line is fluidly connected with a dirty/slurry side of the blender header and wherein the clean fluid line is fluidly connected with another/clean side of the blender header, and wherein the blender header further comprises one or more outlets for extracting the proppant slurry therefrom; and a control system configured to monitor a concentrated slurry flow rate of the concentrated slurry in the concentrated slurry line and a clean fluid flow rate of the clean fluid in the clean fluid line, and control the concentrated slurry pump and the clean fluid pump, such that combination of the concentrated slurry and the clean fluid provides the proppant slurry having the total flow rate, and wherein the controller is further configured to monitor a concentrated slurry pressure of the concentrated slurry in the concentrated slurry line and a clean fluid pressure of the clean fluid in the clean fluid line, and control a proportional valve between the clean side of the blender header and the dirty side of the blender header to ensure that clean fluid passes through the proportional valve, wherein the total flow rate of the proppant slurry is greater than a maximum slurry pump flow rate of a preferred operating range (POR) of the slurry pump, and wherein the concentrated slurry flow rate is less than or equal to the maximum slurry pump flow rate.

18. The system of claim 17, wherein the controller controls operation of the blender such that the clean fluid pressure of the clean fluid in the clean fluid line is at least 5 psi greater than the concentrated slurry pressure of the concentrated slurry in the concentrated slurry line.

19. The system of claim 17 further comprising a flow meter on the concentrated slurry line, a flow meter on the clean fluid line, a pressure transducer on the concentrated slurry line, and a pressure transducer on the clean fluid line, wherein the controller receives concentrated slurry flow rate information from the flow meter on the concentrated slurry line, clean fluid flow rate information from the flow meter on the clean fluid line, concentrated slurry pressure from the pressure transducer on the concentrated slurry line, and clean fluid pressure information from the transducer on the clean fluid line to control operation of the blending system.

20. The system of claim 17 further comprising a manifold configured to feed the proppant slurry to one or more hydraulic fracturing pumps, wherein the manifold is configured to receive: (a) the concentrated slurry and the clean fluid, or (b) the proppant slurry from the blender.

21. The system of claim 17, wherein the slurry pump, the clean fluid pump and the blender header are positioned on a mobile blender apparatus.

* * * * *